US011358744B2

(12) United States Patent
Menta et al.

(10) Patent No.: US 11,358,744 B2
(45) Date of Patent: Jun. 14, 2022

(54) RANDOM CASE SEALER

(71) Applicant: Signode Industrial Group LLC, Glenview, IL (US)

(72) Inventors: William J. Menta, West Wyoming, PA (US); Bryce J. Fox, Honesdale, PA (US)

(73) Assignee: Signode Industrial Group LLC, Tampa, FL (US)

( * ) Notice: Subject to any disclaimer, the term of this patent is extended or adjusted under 35 U.S.C. 154(b) by 404 days.

(21) Appl. No.: 16/353,708

(22) Filed: Mar. 14, 2019

(65) Prior Publication Data

US 2019/0283916 A1 Sep. 19, 2019

Related U.S. Application Data

(60) Provisional application No. 62/719,226, filed on Aug. 17, 2018, provisional application No. 62/644,850, filed on Mar. 19, 2018.

(51) Int. Cl.
*B65B 59/02* (2006.01)
*B65B 61/06* (2006.01)
(Continued)

(52) U.S. Cl.
CPC ..... *B65B 59/02* (2013.01); *B65B 51/067* (2013.01); *B65B 57/02* (2013.01); *B65B 59/005* (2013.01);
(Continued)

(58) Field of Classification Search
CPC ..... B65B 51/067; B65B 57/02; B65B 59/005; B65B 59/02; B65B 61/06; B65B 67/02;
(Continued)

(56) References Cited

U.S. PATENT DOCUMENTS 1,352,899 A 9/1920 Johnson
1,779,985 A 10/1930 Schroeder
(Continued)

FOREIGN PATENT DOCUMENTS

CN 201424150 Y 3/2010
CN 201424151 Y 3/2010
(Continued)

OTHER PUBLICATIONS

"International Search Report and Written Opinion", Application No. PCT/US2019/022495, dated Sep. 12, 2019 (17 pages).
(Continued)

*Primary Examiner* — Robert F Long
*Assistant Examiner* — Eduardo R Ferrero
(74) *Attorney, Agent, or Firm* — Neal, Gerber & Eisenberg LLP

(57) ABSTRACT

Various embodiments of the present disclosure provide a random case sealer. The case sealer includes a top-head-actuating assembly configured to vary the speed of the top-head assembly when ascending (to make room for the case beneath the top-head assembly) and when descending onto the case (to engage the top surface of the case during sealing). This maximizes the speed of the top-head assembly while limiting overshoot (when ascending) and preventing damage to the case (when descending). In certain embodiments the case sealer includes a tape cartridge configured to limit the forces imparted onto the leading and top surfaces of the case during sealing. These features result in increased throughput as compared to prior art random case sealers without requiring stronger cases or more protective dunnage.

17 Claims, 27 Drawing Sheets

(51) Int. Cl.

| | |
|---|---|
| ***B65B 51/06*** | (2006.01) |
| ***B65B 57/02*** | (2006.01) |
| ***B65B 59/00*** | (2006.01) |
| ***B65B 67/02*** | (2006.01) |
| ***B65H 35/00*** | (2006.01) |

(52) U.S. Cl.
CPC ..... *B65B 61/06* (2013.01); *B65B 67/02* (2013.01); *B65H 35/0013* (2013.01); *B65B 2210/04* (2013.01); *B65H 2701/377* (2013.01)

(58) Field of Classification Search
CPC ..... B65B 2210/04; B65H 35/0013; B65H 2701/377
USPC ..... 53/138.1, 136.4
See application file for complete search history.

(56) References Cited

U.S. PATENT DOCUMENTS 2,691,260 A 10/1954 Schlemmer
2,804,738 A 9/1957 Shenigo
3,267,640 A 8/1966 Romney et al.
3,374,604 A 3/1968 Roesner et al.
3,716,962 A 2/1973 Topler et al.
3,769,777 A 11/1973 Freakes et al.
3,775,937 A 12/1973 Devan et al.
3,892,618 A 7/1975 Griebat
3,915,786 A 10/1975 Collett et al.
3,954,550 A 5/1976 Patterson
3,959,950 A 6/1976 Fukuda
3,973,375 A 8/1976 Loveland
4,010,597 A 3/1977 Nelson
4,061,526 A * 12/1977 Warshaw ..... B65B 51/067 53/136.4
4,063,403 A 12/1977 Bergstein et al.
4,079,577 A 3/1978 Ulrich et al.
4,213,285 A 7/1980 Mancini
4,233,798 A 11/1980 Helding
4,293,086 A 10/1981 Fincher et al.
4,295,771 A 10/1981 Mehesan, Jr.
4,317,319 A 3/1982 Price
4,422,282 A 12/1983 Marchetti
4,478,023 A 10/1984 Becker
4,517,784 A 5/1985 Beckett
4,524,560 A 6/1985 Goodman
4,538,398 A * 9/1985 Marchetti ..... B65B 51/067 100/7
4,543,767 A 10/1985 Wiseman
4,545,175 A 10/1985 Beckett
4,554,042 A * 11/1985 Marchetti ..... B65B 51/067 156/350
4,562,686 A 1/1986 Focke
4,565,050 A 1/1986 Norris
4,585,504 A * 4/1986 Marchetti ..... B65B 51/067 156/351
4,642,966 A 2/1987 Marchetti
4,722,165 A 2/1988 Marchetti
4,778,554 A 10/1988 Doman
4,781,786 A 11/1988 Lerner et al.
4,955,177 A 9/1990 Lerner et al.
4,972,654 A 11/1990 Marchetti
4,984,409 A 1/1991 Focke
5,022,214 A 6/1991 Kim
5,063,726 A 11/1991 Boisseau
5,066,346 A 11/1991 Long et al.
5,102,382 A 4/1992 Center et al.
5,173,140 A 12/1992 Vasilakes
5,255,490 A 10/1993 Chiu
5,323,586 A 6/1994 Lissoni et al.
5,338,384 A 8/1994 Reichert
5,341,626 A 8/1994 Beckmann
5,454,776 A 10/1995 Ulrich et al.
5,655,356 A * 8/1997 Ginestra ..... B65B 11/48 53/504
5,685,814 A 11/1997 Le
5,910,090 A * 6/1999 Taute ..... B65B 43/265 53/504
6,067,773 A 5/2000 Le
6,070,396 A 6/2000 Rinaldi et al.
6,308,495 B1 * 10/2001 Sambuca, Jr. ..... A47B 91/022 53/136.4
6,318,048 B1 * 11/2001 Sambuca, Jr. ..... B65B 7/20 493/475
6,318,049 B1 11/2001 Raudat et al.
6,319,183 B1 11/2001 Ballos
6,669,616 B1 12/2003 Bierenacki et al.
6,725,629 B2 4/2004 Pearce et al.
6,910,314 B2 6/2005 Le
7,140,165 B2 11/2006 Ventura et al.
7,269,933 B2 9/2007 Le
7,278,248 B2 10/2007 Vinh
7,331,916 B2 2/2008 Fox
7,383,864 B2 * 6/2008 Hogerton ..... B65B 51/067 156/350
7,819,357 B2 10/2010 Fox et al.
7,886,503 B2 2/2011 Chase et al.
7,937,905 B2 5/2011 Fox et al.
8,079,395 B2 12/2011 Fox et al.
8,109,062 B2 2/2012 Chase et al.
9,630,796 B2 4/2017 Menta et al.
2002/0170271 A1 11/2002 Pearce et al.
2003/0101688 A1 * 6/2003 Albarran ..... B65B 59/003 53/378.3
2004/0068956 A1 4/2004 Hartness et al.
2004/0093829 A1 5/2004 Marchetti
2004/0123559 A1 * 7/2004 Le ..... B65B 51/067 53/136.4
2004/0226268 A1 11/2004 Vinh
2005/0235603 A1 10/2005 Le
2009/0064636 A1 * 3/2009 Chu ..... B65B 59/003 53/136.4
2009/0217535 A1 9/2009 Fox et al.
2009/0218047 A1 9/2009 Fox et al.
2009/0218048 A1 9/2009 Fox et al.
2011/0041464 A1 * 2/2011 Park ..... B65B 57/02 53/476
2012/0102893 A1 5/2012 Sambuca
2012/0227905 A1 * 9/2012 Menta ..... B65B 51/067 156/355
2012/0232699 A1 * 9/2012 Menta ..... B65H 35/0013 700/275
2015/0210418 A1 7/2015 Cheich et al.
2017/0247129 A1 * 8/2017 Menta ..... B65B 57/04
2018/0273335 A1 * 9/2018 Fox ..... B65B 51/06

FOREIGN PATENT DOCUMENTS

CN 101804924 A 8/2010
EP 3053864 A1 8/2016
JP 2007261774 A 10/2007

OTHER PUBLICATIONS

International Search Report for PCT/US2012/028226 dated Jun. 11, 2012.
"Case Sealer Uniform Legend," Little David, Case Sealing for the Real World (2 pages), 2004.
"LDXRTB 2.0 Series Random Top and Bottom Drive Fully Automatic Case Sealer Operator's Manual," Loveshaw, an ITW Company, Little David Case Sealer (100 pages), Feb. 18, 2013.
"Little David Owners Manual LD16R," The Loveshaw Corporation (59 pages).
"Communication pursuant to Article 94(3) EPC", corresponding European Patent Application No. 19 714 049.4 (6 pages), dated Sep. 23, 2021.

* cited by examiner

RANDOM CASE SEALER

PRIORITY CLAIM

This patent application claims priority to and the benefit of U.S. Provisional Patent Application No. 62/719,226, which was filed on Aug. 17, 2018, and U.S. Provisional Patent Application No. 62/644,850, which was filed on Mar. 19, 2018. The entire contents of these patent applications are incorporated herein by reference.

FIELD

The present disclosure relates to case sealers, and more particularly to random case sealers configured to seal cases of different heights.

BACKGROUND

Every day, companies around the world pack millions of items in cases (such as boxes formed from corrugated) to prepare them for shipping. Case sealers partially automate this process by applying pressure-sensitive tape to cases already packed with items and (in certain instances) protective dunnage to seal those cases shut. Random case sealers are a subset of case sealers that automatically adjust to the height of the case to-be-sealed so they can seal cases of different heights.

A typical random case sealer includes a top-head assembly with a pressure switch at its front end. The top-head assembly moves vertically under control of two pneumatic cylinders to accommodate cases of different heights. The top-head assembly includes a tape cartridge configured to apply tape to the top surface of the case as it moves past the tape cartridge. One known tape cartridge includes a front roller assembly, a cutter assembly, a rear roller assembly, a tape-mounting assembly, and a tension-roller assembly. A roll of tape is mounted to the tape-mounting assembly. A free end of the tape is routed through several rollers of the tension-roller assembly until the free end of the tape is adjacent a front roller of the front roller assembly with its adhesive side facing outward (toward the incoming cases).

In operation, an operator moves a case into contact with the pressure switch. In response, pressurized air is introduced into the two pneumatic cylinders to pressurize the volumes below their respective pistons to a first pressure to begin raising the top-head assembly. Once the top-head assembly ascends above the case so the case stops contacting the pressure switch, the operator moves the case beneath the top-head assembly, and the air pressure in the pneumatic cylinders is reduced to a second, lower pressure. When pressurized at the second pressure, the pneumatic cylinders partially counter-balance the weight of the top-head assembly so the top-head assembly gently descends onto the top surface of the case.

A drive assembly of the case sealer moves the case relative to the tape cartridge. This movement causes the front roller of the front roller assembly to contact a leading surface of the case and apply the tape to the leading surface. Continued movement of the case relative to the tape cartridge forces the front roller assembly to retract against the force of a spring. This also causes the rear roller assembly to retract since the roller arm assemblies are linked. As the drive assembly continues to move the case relative to the tape cartridge, the spring forces the front roller to ride along the top surface of the case while applying the tape to the top surface. The spring also forces a rear roller of the rear roller assembly to ride along the top surface of the case (once the case reaches it).

As the drive assembly continues to move the case relative to the tape cartridge, the case contacts the cutter assembly and causes it to retract against the force of another spring, which leads to the cutter assembly riding along the top surface of the case. Once the drive assembly moves the case relative to the tape cartridge so the case's trailing surface passes the cutter assembly, the spring biases the cutter assembly back to its original position. Specifically, the spring biases an arm with a toothed blade downward to contact the tape and sever the tape from the roll, forming a free trailing end of the tape. At this point, the rear roller continues to ride along the top surface of the case, thereby maintaining the front and rear roller arm assemblies in their retracted positions.

Once the drive assembly moves the case relative to the tape cartridge so the case's trailing surface passes the rear roller, the spring forces the front and rear roller assemblies to return to their original positions. As the rear roller assembly does so, it contacts the trailing end of the severed tape and applies it to the trailing surface of the case to complete the sealing process.

One issue with this known random case sealer is that the construction and control of the top-head assembly limits throughput of cases through the machine. Attempting to increase throughput by causing the top-head assembly to ascend faster (via increasing the first pressure) results in the top-head assembly significantly overshooting the top surface of the case. This means that the time saved via the quicker ascent of the top-head assembly would be lost because afterwards the top-head assembly would have to descend further to reach the top surface of the case and thus would take longer to do so.

Another issue is that the second pressure is not variable during operation of the case sealer. Setting the second pressure lower would enable the top-head assembly to descend quicker onto the top surface of the case, but could damage or crush the case. This is particularly likely in instances in which the case is under-filled (e.g., in which the case is not entirely filled with product or protective dunnage to support the top surface of the case) and/or formed from weak corrugated. To counteract this, operators could use cases formed from more robust corrugated or fill the cases with more protective dunnage, but this increases costs and waste.

Another issue is that the biasing force on the front roller assembly of the tape cartridge is strong enough to damage the leading edge of the case when the leading edge of the case initially contacts the front roller and forces the roller assemblies to retract. To counteract this, operators could use cases formed from more robust corrugated or fill the cases with more protective dunnage, but this would increase costs and waste.

Another issue is that the roller and cutter assemblies of the tape cartridge impart significant downward forces on the top surface of the case (via their respective springs) during taping, which can cause the top surface of the case to cave in or otherwise damage the case. Again, to counteract this, operators could use cases formed from more robust corrugated, but this would increase costs.

Another known issue is that extension springs of the tape cartridge that impart biasing forces on the roller and cutter assemblies can exhibit an uncontrollable varying force as they are extended. In particular, with respect to the cutter assembly, this can result in the blade inconsistently cutting the tape. The biasing elements (e.g., springs) can also degrade over time and at a certain point may no longer provide acceptable performance and require replacement. This increases down time and decreases throughput.

There is a continuing need for case sealers configured to seal under-filled or weak cases at high throughput without requiring stronger cases or more protective dunnage.

SUMMARY

Various embodiments of the present disclosure provide a random case sealer. The case sealer includes a top-head-actuating assembly configured to vary the speed of the top-head assembly when ascending (to make room for the case beneath the top-head assembly) and when descending onto the case (to engage the top surface of the case during sealing). This maximizes the speed of the top-head assembly while limiting overshoot (when ascending) and preventing damage to the case (when descending). In certain embodiments the case sealer includes a tape cartridge configured to limit the forces imparted onto the leading and top surfaces of the case during sealing. These features result in increased throughput as compared to prior art random case sealers without requiring stronger cases or more protective dunnage.

DETAILED DESCRIPTION

Figure 1:
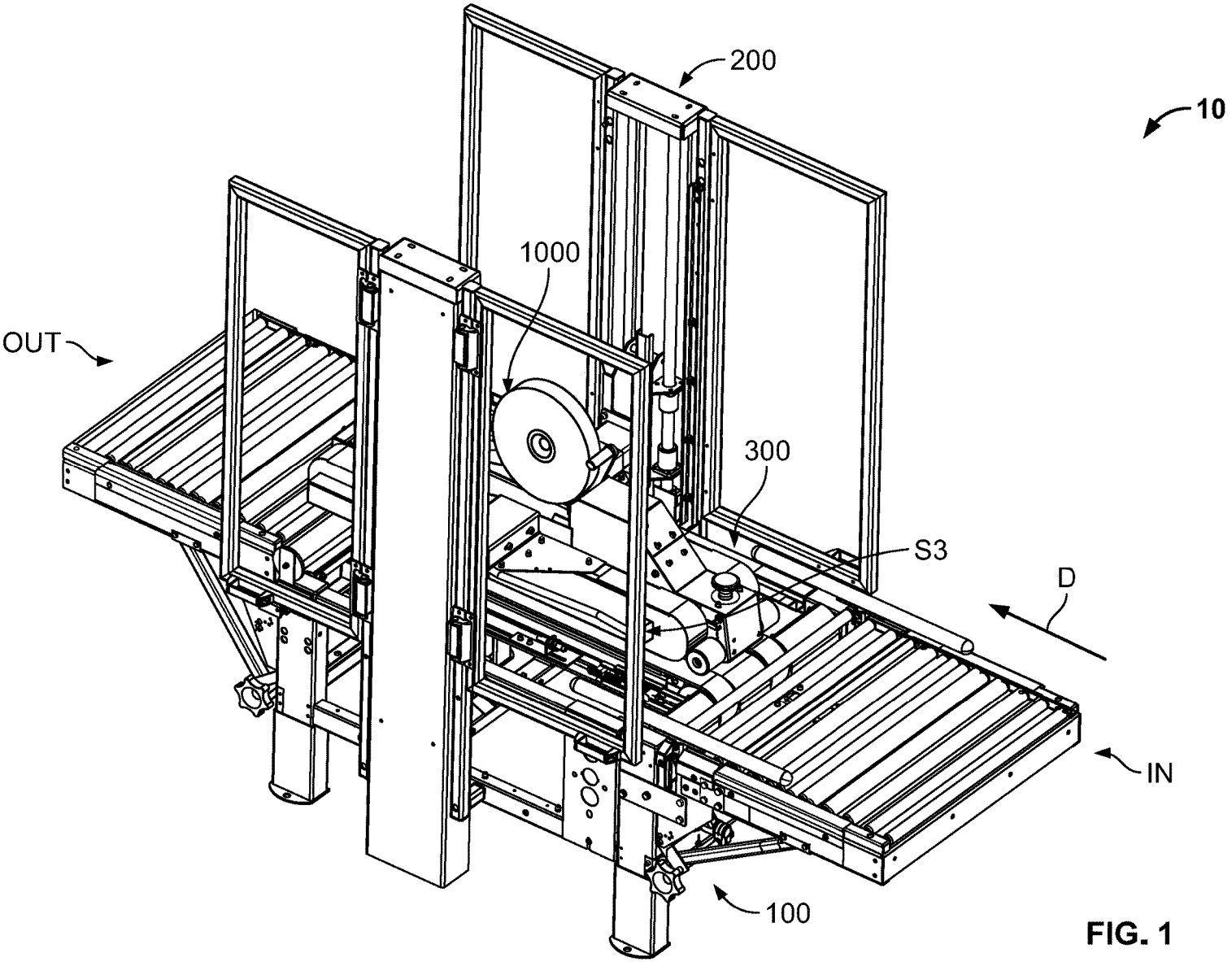
FIG. 1 is a perspective view of one example embodiment of a case sealer of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide a random case sealer. The case sealer includes a top-head-actuating assembly configured to vary the speed of the top-head assembly when ascending (to make room for the case beneath the top-head assembly) and when descending onto the case (to engage the top surface of the case during sealing). This maximizes the speed of the top-head assembly while limiting overshoot (when ascending) and preventing damage to the case (when descending). In certain embodiments the case sealer includes a tape cartridge configured to limit the forces imparted onto the leading and top surfaces of the case during sealing. These features result in increased throughput as compared to prior art random case sealers without requiring stronger cases or more protective dunnage.

Figure 2:
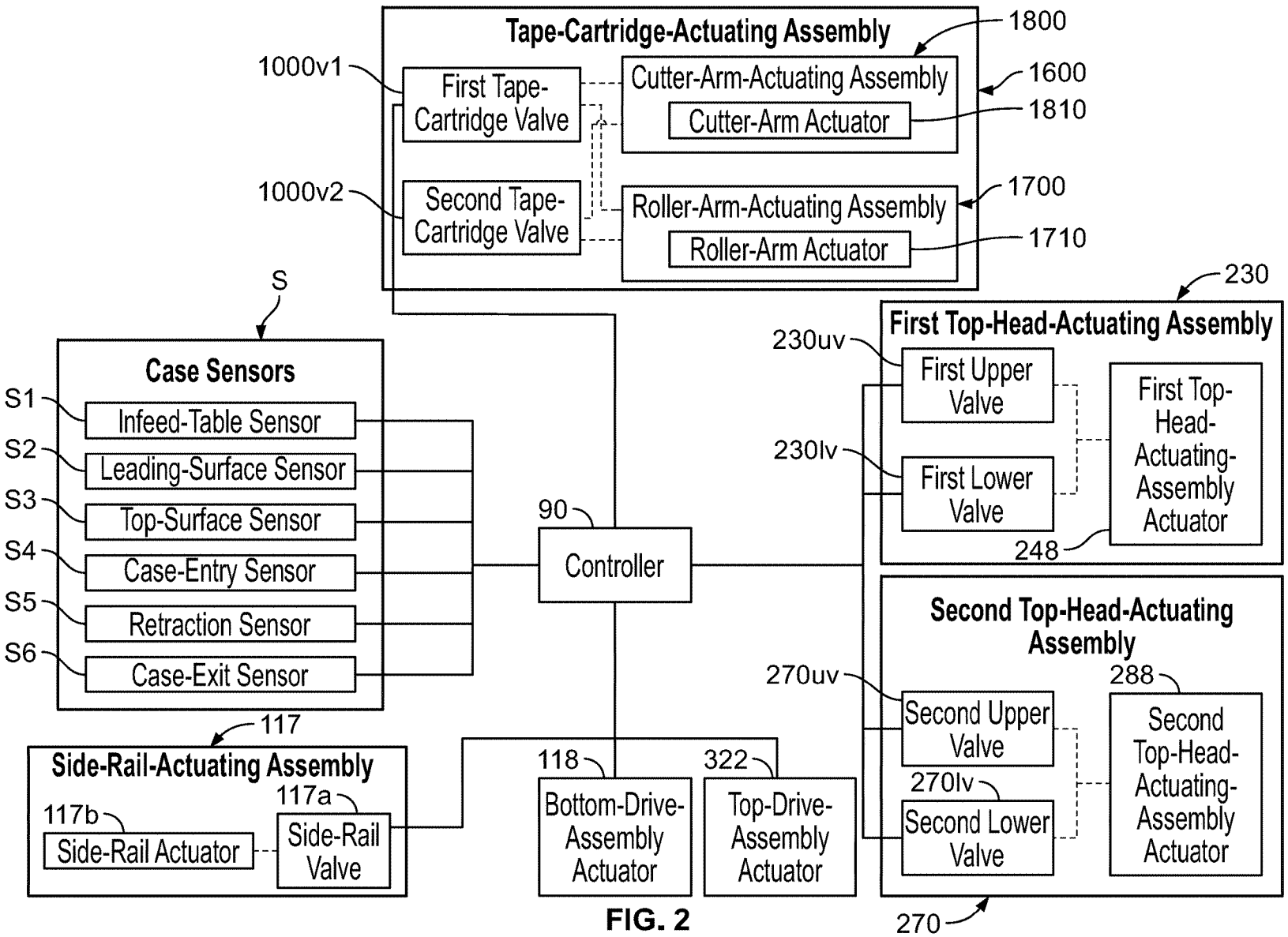
FIG. 2 is a block diagram showing certain components of the case sealer of FIG. 1.

FIG. 1 shows one example embodiment of a case sealer 10 of the present disclosure. The case sealer 10 includes a base assembly 100, a mast assembly 200, a top-head assembly 300, an upper tape cartridge 1000, and a lower tape cartridge (not shown for clarity). As shown in FIG. 2, the case sealer 10 also includes several actuating assemblies and actuators configured to control movement of certain components of the case sealer 10; multiple sensors S; and control circuitry and systems for controlling the actuating assemblies and the actuators (and other mechanical, electromechanical, and electrical components of the case sealer 10) responsive to signals received from the sensors S.

A controller 90 is communicatively connected to the sensors S to send and receive signals to and from the sensors S. The controller 90 is operably connected to the actuating assemblies and the actuators to control the actuating assemblies and the actuators. The controller 90 may be any suitable type of controller (such as a programmable logic controller) that includes any suitable processing device(s) (such as a microprocessor, a microcontroller-based platform, an integrated circuit, or an application-specific integrated circuit) and any suitable memory device(s) (such as random access memory, read-only memory, or flash memory). The memory device(s) stores instructions executable by the processing device(s) to control operation of the case sealer 10.

Figure 3:
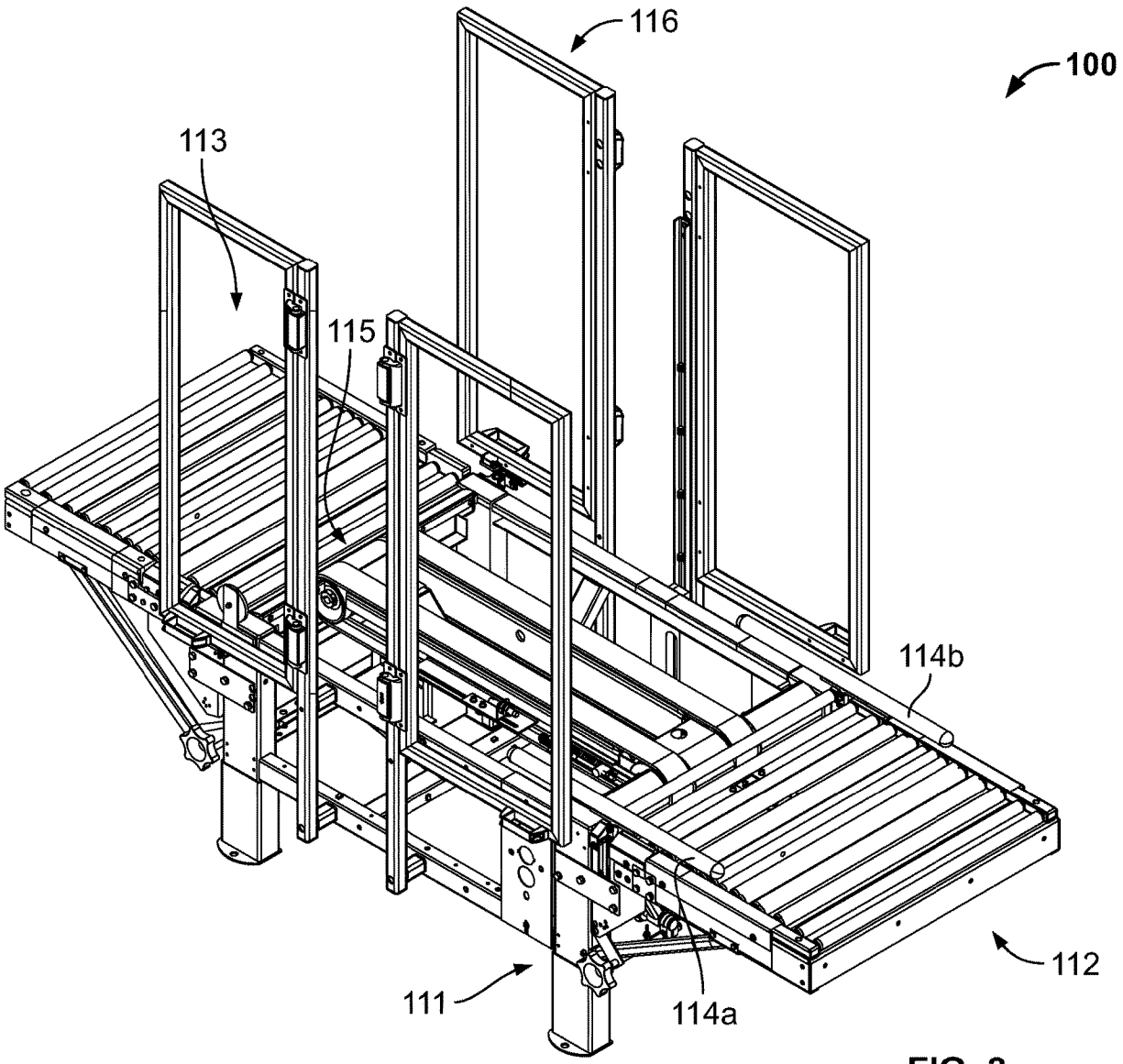
FIG. 3 is a perspective view of the base assembly of the case sealer of FIG. 1.

The base assembly 100 is configured to align cases in preparation for sealing and to move the cases through the case sealer 10 while supporting the mast assembly 200 (which supports the top-head assembly 300). As best shown in FIG. 3, the base assembly 100 includes a base-assembly frame 111, an infeed table 112, an outfeed table 113, a side-rail assembly 114 (not shown but numbered for clarity), a bottom-drive assembly 115, and a barrier assembly 116. The base assembly 100 defines an infeed end IN (FIG. 1) of the case sealer 10 at which an operator (or an automated feed system) feeds cases to-be-sealed into the case sealer 10 (via the infeed table 112) and an outfeed end OUT (FIG. 1) of the case sealer 10 at which the case sealer 10 ejects sealed cases onto the outfeed table 113.

The base-assembly frame 111 is formed from any suitable combination of solid and/or tubular members and/or plates fastened together. The base-assembly frame 111 is configured to support the other components of the base assembly 100.

The infeed table 112 is mounted to the base-assembly frame 111 adjacent the infeed end IN of the case sealer 10. The infeed table 112 includes multiple rollers on which the operator can place and fill a case and then use to convey the filled case to the top-head assembly 300. The infeed table 112 includes an infeed-table sensor S1 (FIG. 2), which may be any suitable sensor (such as a photoelectric sensor) configured to detect the presence of a case on the infeed table 112 (and, more particularly, the presence of a case at a particular location on the infeed table 112 that corresponds to the location of the infeed-table sensor S1). In other embodiments, another component of the case sealer 10 includes the infeed-table sensor S1. The infeed-table sensor S1 is communicatively connected to the controller 90 to send signals to the controller 90 responsive to detecting a case and, afterwards, no longer detecting the case, as described below.

The outfeed table 113 is mounted to the base-assembly frame 111 adjacent the outfeed end OUT of the case sealer 10. The outfeed table 113 includes multiple rollers onto which the case is ejected after taping.

The side-rail assembly 114 is supported by the base-assembly frame 111 adjacent the infeed table 112 and includes first and second side rails 114*a* and 114*b* and a side-rail-actuating assembly 117 (FIG. 2). The side rails 114*a* and 114*b* extend generally parallel to a direction of travel D (FIG. 1) of a case through the case sealer 10 and are movable laterally inward (relative to the direction of travel D) to laterally center the case on the infeed table 112. The side-rail-actuating assembly 117 is operably connected to the first and second side rails 114*a* and 114*b* to move the side rails between: (1) a rest configuration (FIG. 1) in which the side rails are positioned at or near the lateral extents of the infeed table 112 to enable an operator to position a case to-be-sealed between the side rails on the infeed table 112; and (2) a centering configuration (FIG. 8A) in which the side rails (after being moved toward one another) contact the case and center the case on the infeed table 112. In this example embodiment, the side-rail-actuating assembly 117 includes a side-rail valve 117*a* and a side-rail actuator 117*b* (FIG. 2) in the form of a side-rail double-acting pneumatic cylinder. The side-rail pneumatic cylinder 117*b* is operably connected to the first and second side rails 114*a* and 114*b* (either directly or via suitable linkages). The side-rail valve 117*a* is fluidly connectable to a pressurized gas source (not shown) and with the side-rail pneumatic cylinder 117*b* (dashed line in FIG. 2) and configured to direct pressurized gas into the side-rail pneumatic cylinder 117*b* on either side of its piston to control movement of the side rails 114*a* and 114*b* between the rest and centering configurations. This is merely one example embodiment, and the side-rail-actuating assembly 117 may include any suitable actuator (such as a motor) in other embodiments.

The controller 90 is operably connected to the side-rail-actuating assembly 117 to control the side-rail-actuating assembly 117 to move the side rails 114*a* and 114*b* between the rest and centering configurations. Specifically: (1) when the side rails 114*a* and 114*b* are in the rest configuration, the controller 90 is configured to control the side-rail valve 117*a* to direct pressurized gas into the side-rail pneumatic cylinder 117*b* on the appropriate side of the piston to cause the side-rail pneumatic cylinder 117*b* to move the side rails 114*a* and 114*b* from the rest configuration to the centering configuration; and (2) when the side rails 114*a* and 114*b* are in the centering configuration, the controller 90 is configured to control the side-rail valve 117*a* to direct pressurized gas into the side-rail pneumatic cylinder 117*b* on the opposite side of the piston to cause the side-rail pneumatic cylinder 117*b* to move the side rails 114*a* and 114*b* from the centering configuration to the rest configuration.

The bottom-drive assembly 115 is supported by the base-assembly frame 111 and (along with a top-drive assembly 320, described below) configured to move cases in the direction D. The bottom-drive assembly 115 includes a bottom drive element and a bottom-drive-assembly actuator 118 (FIG. 2) operably connected to the bottom drive element to drive the bottom drive element to (along with the top-drive assembly 320) move cases through the case sealer 10. In this example embodiment, the bottom-drive-assembly actuator 118 includes a motor that is operably connected to the bottom drive element-which includes an endless belt in this example embodiment-via one or more other components, such as sprockets, gearing, screws, tensioning elements, and/or a chain. The bottom-drive-assembly actuator 118 may include any other suitable actuator in other embodiments. The bottom-drive element may include any other suitable component or components, such as rollers, in other embodiments. The controller 90 is operably connected to the bottom-drive-assembly actuator 118 to control operation of the bottom-drive-assembly actuator 118.

The barrier assembly 116 includes four individually framed barriers (not labeled) that are formed from clear material, such as plastic or glass. The barriers are connected to the base-assembly frame 111 so one pair of barriers flanks the first top-head-mounting assembly 210 (described below) and the other pair of barriers flanks the second top-head-mounting assembly 250 (described below). When connected to the base-assembly frame 111, the barriers are laterally offset from the top-head assembly 300 to prevent undesired objects from entering the area surrounding the top-head assembly 300 from the sides.

Figure 4A:
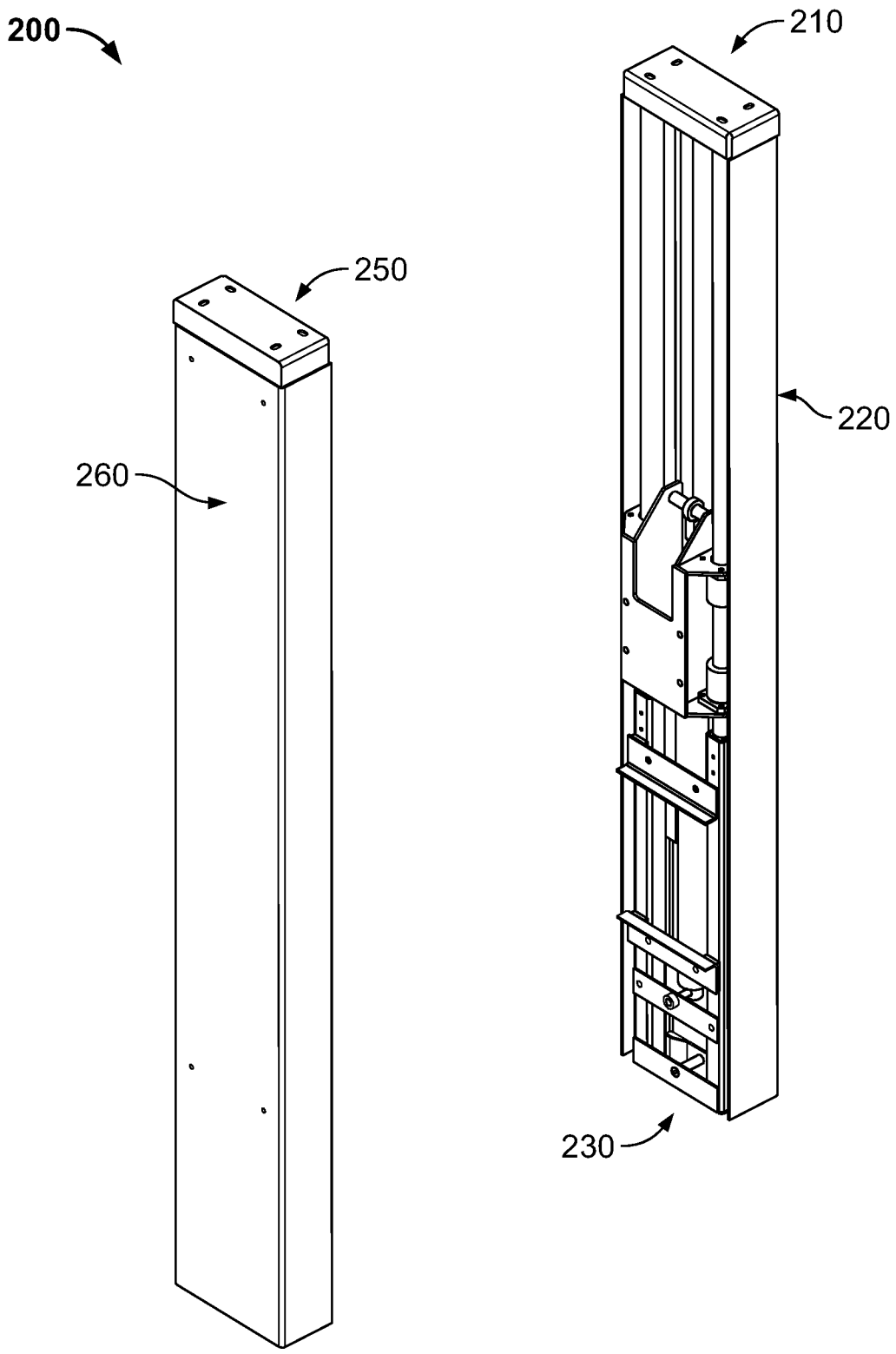
FIG. 4A is a perspective view of the mast assembly of the case sealer of FIG. 1.
Figure 4B:
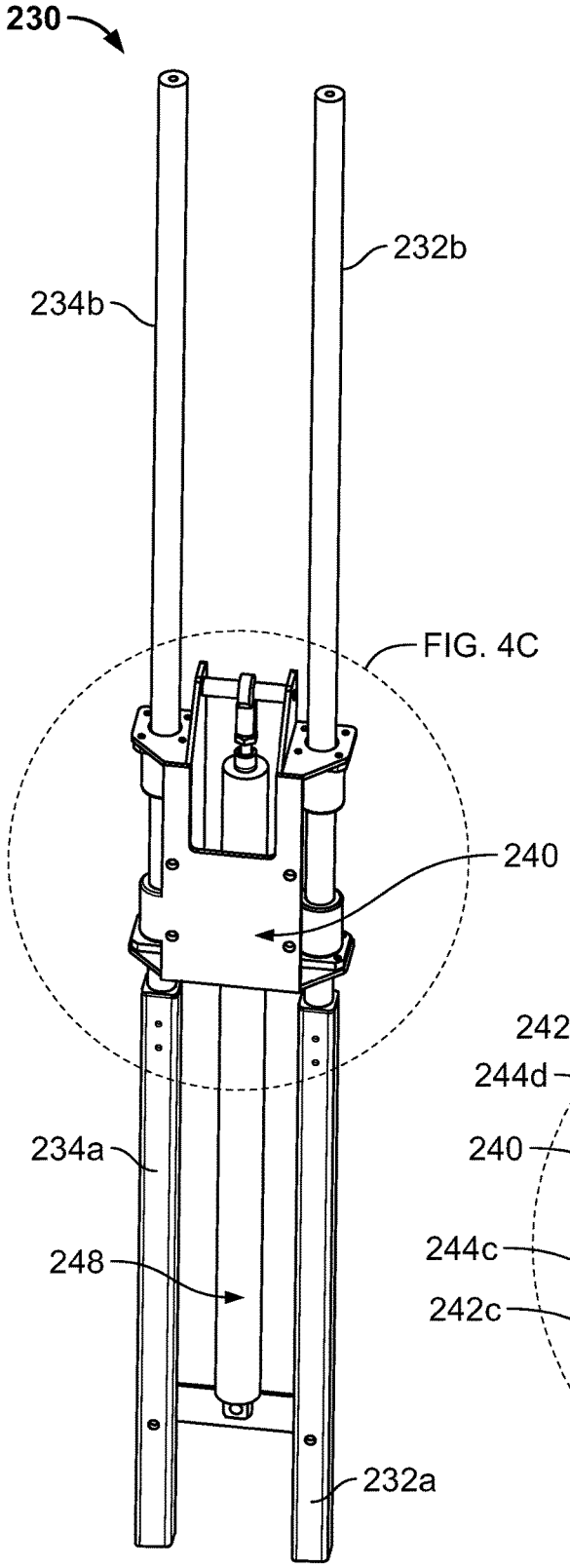
FIG. 4B is a perspective view of the first top-head-actuating assembly of the mast assembly of FIG. 4A.
Figure 4C:
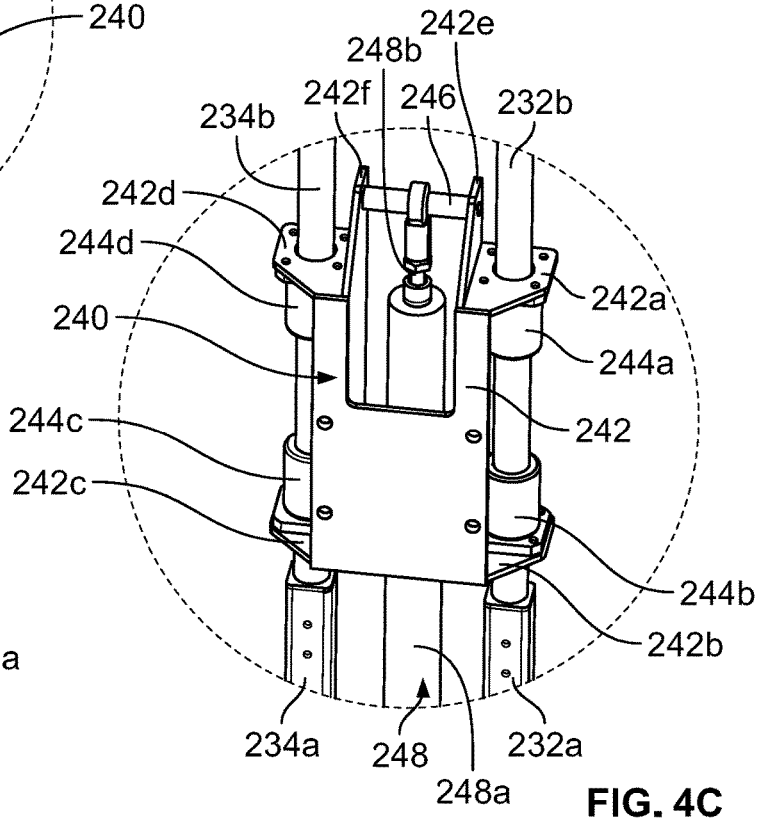
FIG. 4C is a fragmentary perspective view of part of the first top-head-actuating assembly of FIG. 4B.

The mast assembly 200 is configured to support and control vertical movement of the top-head assembly 300 relative to the base assembly 100. As best shown in FIGS. 4A-4C, the mast assembly 200 includes (in this example embodiment) identical first and second top-head-mounting assemblies 210 and 250. The first top-head-mounting assembly 210 is connected to one side of the base-assembly frame 111 via mounting plates and fasteners (not labeled) or in any other suitable manner. Similarly, the second top-head-assembly 250 is connected to the opposite side of the base-assembly frame 111 via mounting plates and fasteners (not labeled) or in any other suitable manner. In this example embodiment, the first and second top-head-mounting assemblies 210 and 250 are fixedly connected to the base assembly 100.

The first top-head-mounting assembly 210 includes an enclosure 220 that is connected to (via suitable fasteners or in any other suitable manner) and partially encloses part of a first top-head-actuating assembly 230. As best shown in FIGS. 2, 4B, 4C, and 8A-8F, the first top-head-actuating assembly 230 includes first and second rail mounts 232*a* and 234*a*, first and second rails 232*b* and 234*b*, a carriage 240, a first top-head-actuating-assembly actuator 248 in the form of a first top-head-mounting-assembly double-acting pneumatic cylinder, a first top-head-actuating-assembly upper valve 230*uv*, and a first top-head-actuating-assembly lower valve 2301*v*.

The first and second rail mounts 232*a* and 234*a* include elongated tubular members having a rectangular cross-section, and the first and second rails 232*b* and 234*b* are elongated solid (or in certain embodiments, tubular) members having a circular cross-section. The first rail 232*b* is mounted to the first rail mount 232*a* so the first rail 232*b* and the first rail mount 232*a* share the same longitudinal axis. The second rail 234*b* is mounted to the second rail mount 234*a* so the second rail 234*b* and the second rail mount 234*a* share the same longitudinal axis.

The carriage 240 includes a body 242 that includes a first pair of outwardly extending spaced-apart mounting wings 242*a* and 242*b*, a second pair of outwardly extending spaced-apart mounting wings 242*c* and 242*d*, a pair of upwardly extending mounting ears 242*e* and 242*f*, four linear bearings 244*a*-244*d*, and a shaft 246. Each mounting wing 242*a*-242*f* defines a mounting opening therethrough (not labeled). Each linear bearing 244*a*-244*d* defines a mounting bore therethrough (not labeled). The linear bearings 244*a*-244*d* are connected to the mounting wings 242*a*-242*d*, respectively, so the mounting openings of the mounting wings and the mounting bores of the linear bearings are aligned. The shaft 246 is received in the mounting openings of the mounting ears 242*e* and 242*f* so the shaft 246 extends between those mounting ears.

The first top-head-actuating-assembly pneumatic cylinder 248 includes a cylinder 248*a*, a piston rod 248*b* having an exposed end outside the cylinder 248*a*, and a piston 248*c* (FIGS. 8A-8F) slidably disposed within the cylinder 248*a* and connected to the other end of the piston rod 248*b*. An upper port (not shown) is in fluid communication with the interior of the cylinder 248*a* above the piston 248*c* to enable pressurized gas to be directed into the cylinder 248*a* above the piston 248*c* (as described below), and a lower port (not shown) is in fluid communication with the interior of the cylinder 248*a* below the piston 248*c* to enable pressurized gas to be directed into the cylinder 248*a* below the piston 248*c* (as described below).

The first top-head-actuating-assembly upper valve 230*uv* (FIGS. 2 and 8A-8F) includes a solenoid valve fluidly connectable to a pressurized gas source and the first top-head-actuating-assembly pneumatic cylinder 248 (dashed line in FIG. 2) and configured to direct pressurized gas into the upper port of the cylinder 248*a*. The first top-head-actuating-assembly lower valve 2301*v* (FIGS. 2 and 8A-8F) includes a solenoid valve fluidly connectable to the pressurized gas source and the first top-head-actuating-assembly pneumatic cylinder 248 (dashed line in FIG. 2) and configured to direct pressurized gas into the lower port of the cylinder 248*a*. The controller 90 is operably connected to the first top-head-actuating-assembly upper valve 230*uv* and the first top-head-actuating-assembly lower valve 2301*v* to control operation of those valves to control vertical movement of the top-head assembly 300 by pressurizing and depressurizing the first top-head-actuating-assembly pneumatic cylinder 248, as described in detail below.

The carriage 240 is slidably mounted to the first and second rails 232*b* and 234*b* via: (1) receiving the first rail 232*b* through the mounting openings in the mounting wings 242*a* and 242*b* and the mounting bores in the linear bearings 244*a* and 244*b*; and (2) receiving the second rail 234*a* through the mounting openings in the mounting wings 242*c* and 242*d* and the mounting bores in the linear bearings 244*c* and 244*d*. The first top-head-actuating-assembly pneumatic cylinder 248 is operably connected to the carriage 240 to move the carriage along and relative to the rails 232*b* and 234*b*. Specifically, a lower end of the cylinder 248*a* is connected to a plate (not labeled) that extends between the first and second rail supports 232*a* and 234*a*, and the exposed end of the piston rod 248*b* is connected to the shaft 246. In this configuration, extension of the piston rod 248*b* causes the carriage 240 to move upward along the rails 232*b* and 234*b*, and retraction of the piston rod 248*b* causes the carriage 240 to move downward along the rails 232*b* and 234*b*.

The second top-head-mounting assembly 250 includes an enclosure 260 that is connected to (via suitable fasteners or in any other suitable manner) and partially encloses part of a second top-head-actuating assembly 270 (FIG. 2). Although not separately shown for brevity (since the first and second top-head-mounting assemblies are identical in this example embodiment), the components of the second top-head-actuating assembly 270 are numbered below for clarity and ease of reference. The second top-head-actuating assembly 270 includes first and second rail mounts 272*a* and 274*a*, first and second rails 272*b* and 274*b*, a carriage 280, a second top-head-actuating-assembly actuator 288 in the form of a second top-head-actuating-assembly pneumatic cylinder 288, a second top-head-actuating-assembly upper valve 270*uv*, and a second top-head-actuating-assembly lower valve 2701*v*.

The first and second rail mounts 272*a* and 274*a* include elongated tubular members having a rectangular cross-section, and the first and second rails 272*b* and 274*b* are elongated solid (or in certain embodiments, tubular) members having a circular cross-section. The first rail 272*b* is mounted to the first rail mount 272*a* so the first rail 272*b* and the first rail mount 272*a* share the same longitudinal axis. The second rail 274*b* is mounted to the second rail mount 274*a* so the second rail 274*b* and the second rail mount 274*a* share the same longitudinal axis.

The carriage 280 includes a body 282 that includes a first pair of outwardly extending mounting wings 282*a* and 282*b*, a second pair of outwardly extending mounting wings 282*c* and 282*d*, a pair of upwardly extending mounting ears 282*e* and 282*f*, four linear bearings 284*a*-284*d*, and a shaft 286. Each mounting wing 282*a*-282*f* defines a mounting opening therethrough (not labeled). Each linear bearing 284*a*-284*d* defines a mounting bore therethrough (not labeled). The linear bearings 284*a*-284*d* are connected to the mounting wings 282*a*-282*d*, respectively, so the mounting openings of the mounting wings and the mounting bores of the linear bearings are aligned. The shaft 286 is received in the mounting openings of the mounting ears 282*e* and 282*f* so the shaft 286 extends between those mounting ears.

The second top-head-actuating-assembly pneumatic cylinder 288 includes a cylinder 288*a*, a piston rod 288*b* having an exposed end outside the cylinder 288*a*, and a piston 288*c* slidably disposed within the cylinder 288*a* and connected to the other end of the piston rod 288*b*. An upper port is in fluid communication with the interior of the cylinder 288*a* above the piston 288*c* to enable pressurized gas to be directed into the cylinder 288*a* above the piston 288*c* (as described below), and a lower port is in fluid communication with the interior of the cylinder 288*a* below the piston 288*c* to enable pressurized gas to be directed into the cylinder 288*a* below the piston 288*c* (as described below).

The second top-head-actuating-assembly upper valve 270*uv* (FIG. 2) is a solenoid valve fluidly connectable to a pressurized gas source and the second top-head-actuating-assembly pneumatic cylinder 288 (dashed line in FIG. 2) and configured to direct pressurized gas into the upper port of the cylinder 288*a*. The second top-head-actuating-assembly lower valve 2701*v* (FIG. 2) is a solenoid valve fluidly connectable to the pressurized gas source and the second top-head-actuating-assembly pneumatic cylinder 288 (dashed line in FIG. 2) and configured to direct pressurized gas into the lower port of the cylinder 288*a*. The controller 90 is operably connected to the second top-head-actuating-assembly upper valve 270*uv* and the second top-head-actuating-assembly lower valve 2701*v* to control operation of those valves to control vertical movement of the top-head assembly 300 by pressurizing and de-pressurizing the second top-head-actuating-assembly pneumatic cylinder 288, as described in detail below.

The carriage 280 is slidably mounted to the first and second rails 272*b* and 274*b* via: (1) receiving the first rail 272*b* through the mounting openings in the mounting wings 282*a* and 282*b* and the mounting bores in the linear bearings 284*a* and 284*b*; and (2) receiving the second rail 274*a* through the mounting openings in the mounting wings 282*c* and 282*d* and the mounting bores in the linear bearings 284*c* and 284*d*. The second top-head-actuating-assembly pneumatic cylinder 288 is operably connected to the carriage 280 to move the carriage along and relative to the rails 272*b* and 274*b*. Specifically, a lower end of the cylinder 288*a* is connected to a plate (not labeled) that extends between the first and second rail supports 272*a* and 274*a*, and the exposed end of the piston rod 288*b* is connected to the shaft 286. In this configuration, extension of the piston rod 288*b* causes the carriage 280 to move upward along the rails 272*b* and 274*b*, and retraction of the piston rod 288*b* causes the carriage 280 to move downward along the rails 272*b* and 274*b*.

In other embodiments, the case sealer 10 includes: (1) a single top-head-actuating-assembly upper valve fluidly connectable to a pressurized gas source, the first top-head-actuating-assembly pneumatic cylinder 248, and the second top-head-actuating-assembly pneumatic cylinder 288 and configured to direct pressurized gas into the upper ports of their respective cylinders 248*a* and 288*a*; and (2) a single top-head-actuating-assembly lower valve fluidly connectable to the pressurized gas source, the first top-head-actuating-assembly pneumatic cylinder 248, and the second top-head-actuating-assembly pneumatic cylinder 288 and configured to direct pressurized gas into the lower ports of their respective cylinders 248*a* and 288*a*. For instance, in certain embodiments each of these valves includes a tee fitting to simultaneously direct pressurized air to the appropriate side (depending on the valve) of both cylinders.

In other embodiments, the case sealer includes a single top-head-actuating assembly configured to control the vertical movement of the top-head assembly.

Figure 5:
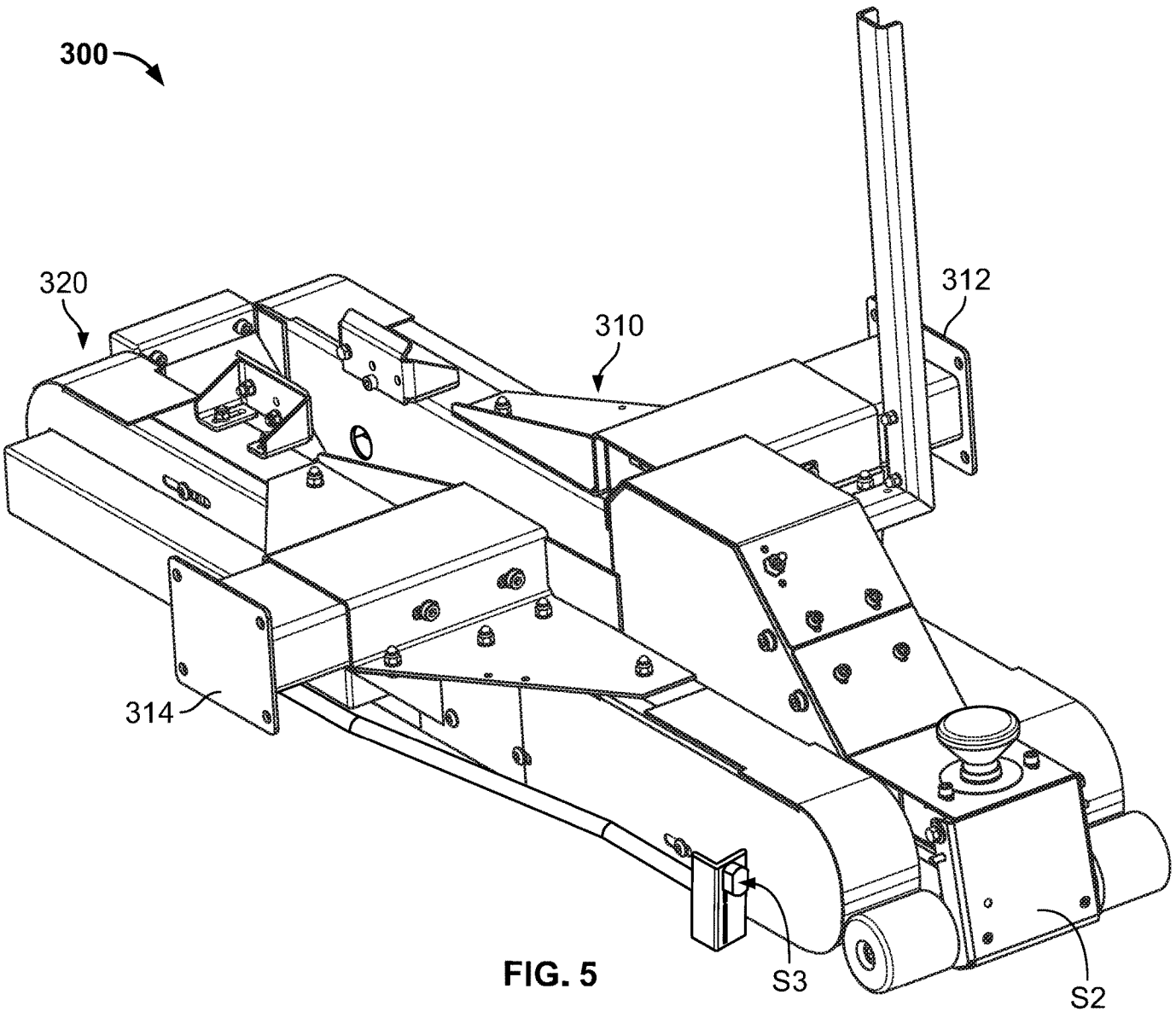
FIG. 5 is a perspective view of the top-head assembly of the case sealer of FIG. 1.

The top-head assembly 300 is movably supported by the mast assembly 200 to adjust to cases of different heights and is configured to move the cases through the case sealer 10, engage the top surfaces of the cases while doing so, and support the tape cartridge 1000. As best shown in FIGS. 2 and 5, the top-head assembly 300 includes a top-head-assembly frame 310, a top-drive assembly 320, a leading-surface sensor S2, a top-surface sensor S3, a case-entry sensor S4, a retraction sensor S5, and a case-exit sensor S6. In other embodiments, one or more other components of the case sealer 10 (such as the base assembly 100 and/or the mast assembly 200) include the one or more of the sensors S2-S6.

The top-head-assembly frame 310 is configured to mount the top-head assembly 300 to the mast assembly 200 and to support the other components of the top-head assembly 300, and is formed from any suitable combination of solid or tubular members and/or plates fastened together. The top-head-assembly frame 310 includes laterally extending first and second mounting arms 312 and 314 that are connected to the carriages 240 and 280, respectively, of the first and second top-head-mounting assemblies 210 and 250 via suitable fasteners. A top-surface sensor mount (not labeled) carrying the top-surface sensor S3 is connected to the second mounting arm 314.

The top-drive assembly 320 is supported by the top-head-assembly frame 310 and (along with the bottom-drive assembly 115, described above) configured to move cases in the direction D. The top-drive assembly 320 includes a top-drive element and a top-drive-assembly actuator 322 (FIG. 2) operably connected to the top-drive element to drive the top-drive element to (along with the bottom-drive assembly 115) move cases through the case sealer 10. In this example embodiment, the top-drive-assembly actuator 322 includes a motor that is operably connected to the top-drive element-which includes an endless belt in this example embodiment-via one or more other components, such as sprockets, gearing, screws, tensioning elements, and/or a chain. The top-drive-assembly actuator 322 may include any other suitable actuator in other embodiments. The top-drive element may include any other suitable component or components, such as rollers, in other embodiments. The controller 90 is operably connected to the top-drive-assembly actuator 322 to control operation of the top-drive-assembly actuator 322.

The leading-surface sensor S2 includes a mechanical paddle switch (or any other suitable sensor, such as a proximity sensor) positioned at a front end of the top-head-assembly frame 310 and configured to detect when the leading surface of a case initially contacts (or is within a predetermined distance of) the top-head assembly 300. The leading-surface sensor S2 is communicatively connected to the controller 90 to send signals to the controller 90 responsive to actuation and de-actuation of the leading-surface sensor S2 (corresponding to the leading-surface sensor S2 detecting and no longer detecting the case).

The top-surface sensor S3 includes a proximity sensor (or any other suitable sensor) configured to detect the presence of a case. Here, although not shown, the top-surface sensor S3 is positioned at the front end of the top-head-assembly frame 310 and above at least part of the leading-surface sensor S2 so the top-surface sensor S3 can detect the top surface of the case C (as described below). The top-surface sensor S3 is communicatively connected to the controller 90 to send signals to the controller 90 responsive to detecting the case and no longer detecting the case.

The case-entry sensor S4 includes a proximity sensor (or any other suitable sensor) configured to detect the presence of a case. Here, although not shown, the top-surface sensor S4 is positioned on the underside of the top-head-assembly frame 310 near the front end of the top-head-assembly frame 310 so the case-entry sensor S4 can detect when a case enters the space below the top-head assembly 300. The case-entry sensor S4 is communicatively connected to the controller 90 to send signals to the controller 90 responsive to detecting the case and no longer detecting the case.

The retraction sensor S5 includes a proximity sensor (or any other suitable sensor) configured to detect the presence of a case. Here, although not shown, the retraction sensor S5 is positioned on the underside of the top-head-assembly frame 310 downstream of the case-entry sensor S4 so the retraction sensor S5 can detect when a case reaches a particular position underneath the top-head assembly 300 (here, a position just before the case contacts the front roller, as explained below). Here, "downstream" means in the direction of travel D, and "upstream" means the direction opposite the direction of travel D. The retraction sensor S5 is communicatively connected to the controller 90 to send signals to the controller 90 responsive to detecting the case and no longer detecting the case.

The case-exit sensor S6 includes a proximity sensor (or any other suitable sensor) configured to detect the presence of a case. Here, although not shown, the case-exit sensor S6 is positioned on the underside of the top-head-assembly frame 310 near the rear end of the top-head-assembly frame 310 (downstream of the case-entry and retraction sensors S4 and S5) so the case-exit sensor S6 can detect when a case exits from beneath the top-head assembly 300. The case-exit sensor S6 is communicatively connected to the controller 90 to send signals to the controller 90 responsive to detecting the case and no longer detecting the case.

The controller 90 is operably connected to (1) the first and second top-head-actuating assemblies 230 and 270 and configured to control the first and second top-head-actuating assemblies 230 and 270 to control vertical movement of the top-head assembly 300 responsive to signals received from the sensors S2-S4 and S6 and (2) the upper tape cartridge 1000 and configured to control the force-reduction functionality of the upper tape cartridge 1000 responsive to signals received from the sensor S5, as described in detail below in conjunction with FIGS. 7A-8F.

Figure 6A:
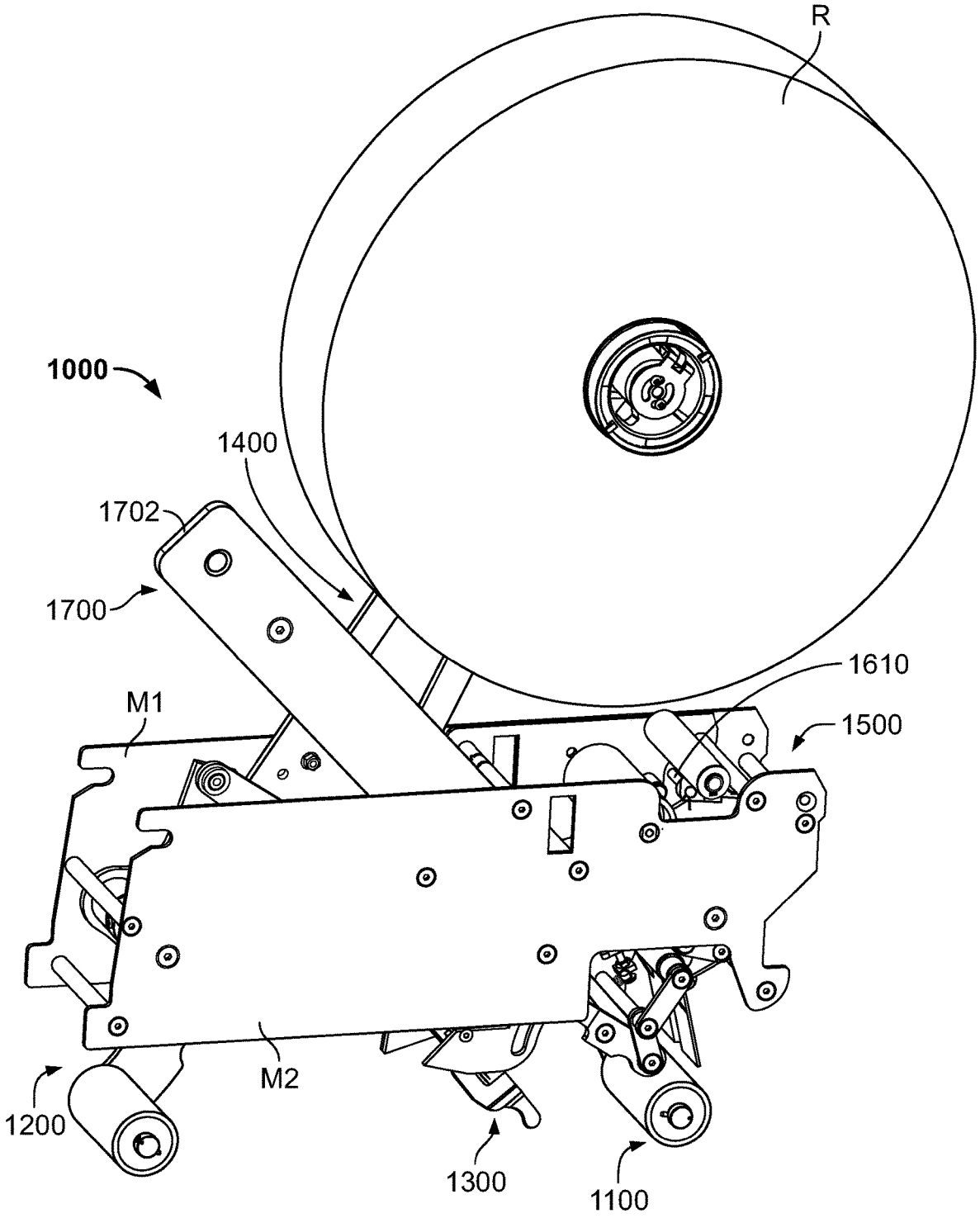
FIGS. 6A-6H are various views of the tape cartridge (and components thereof) of the case sealer of FIG. 1.
Figure 6B:
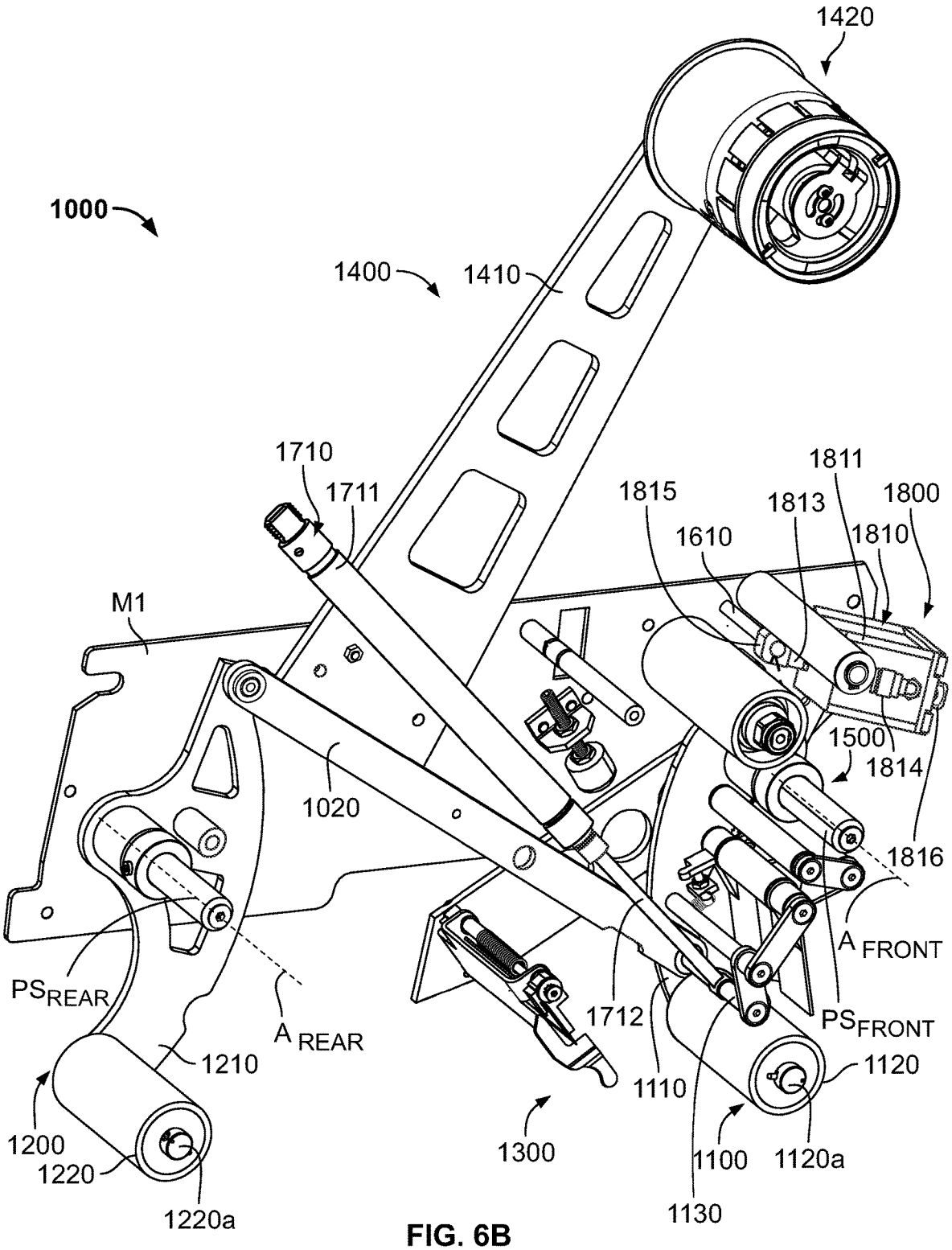
Figure 6C:
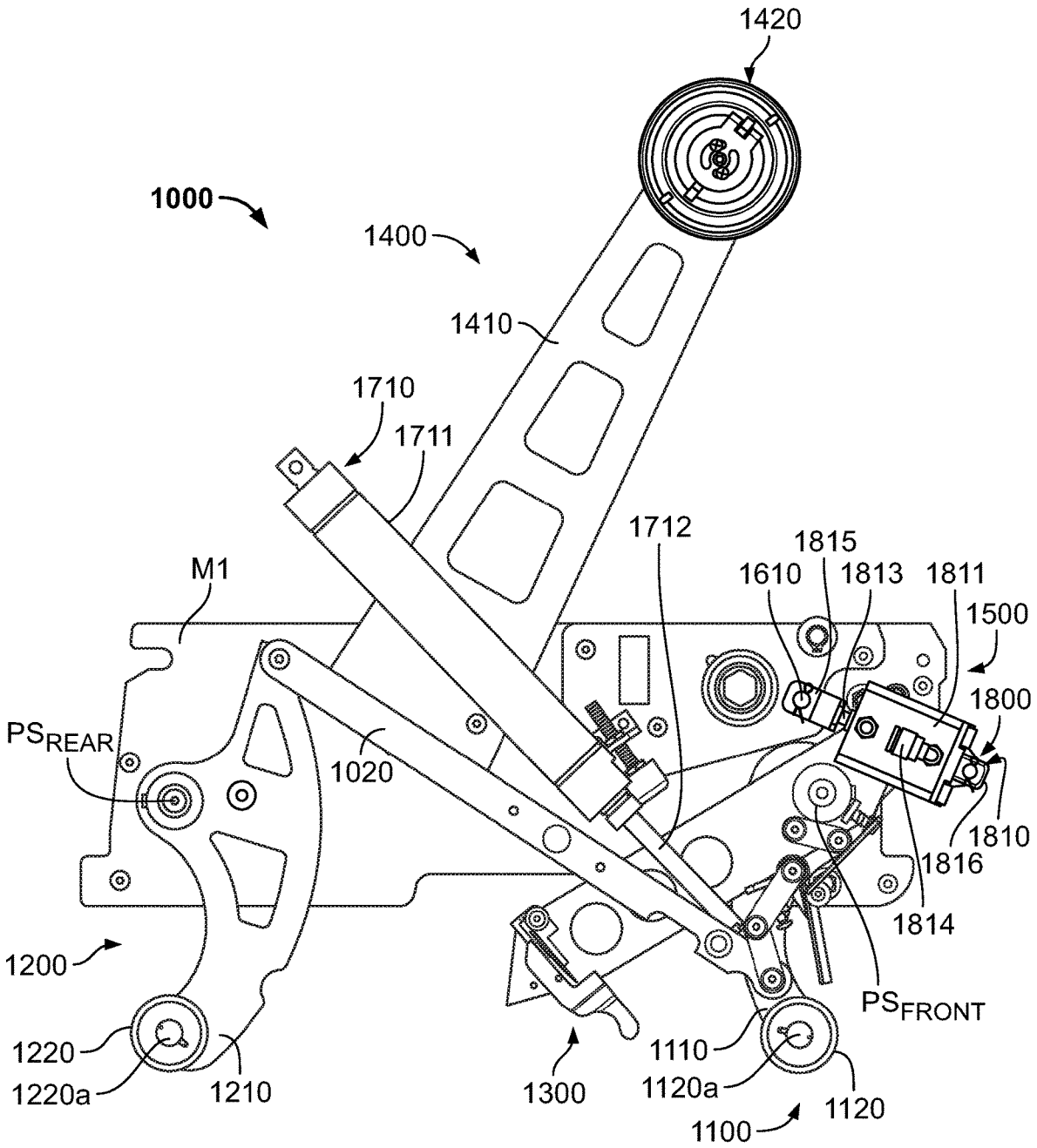

The upper tape cartridge 1000 is removably mounted to the top head assembly 300 and configured to apply tape to a leading surface, a top surface, and a trailing surface of a case. Although not separately described, the lower tape cartridge is removably mounted to the base assembly 100 and configured to apply tape to the leading surface, the bottom surface, and the trailing surface of the case. As best shown in FIGS. 2 and 6A-6H, the tape cartridge 1000 includes a first mounting plate M1 that supports a front roller assembly 1100, a rear roller assembly 1200, a cutter assembly 1300, a tape-mounting assembly 1400, a tension-roller assembly 1500, and a tape-cartridge-actuating assembly 1600. As best shown in FIG. 6A, a second mounting plate M2 is mounted to the first mounting plate M1 via multiple spacer shafts and fasteners (not labeled) to partially enclose certain elements of the front roller assembly 1100, the rear roller assembly 1200, the cutter assembly 1300, the tape-mounting assembly 1400, the tension-roller assembly 1500, and the tape-cartridge-actuating assembly 1600 therebetween.

Figure 6D:
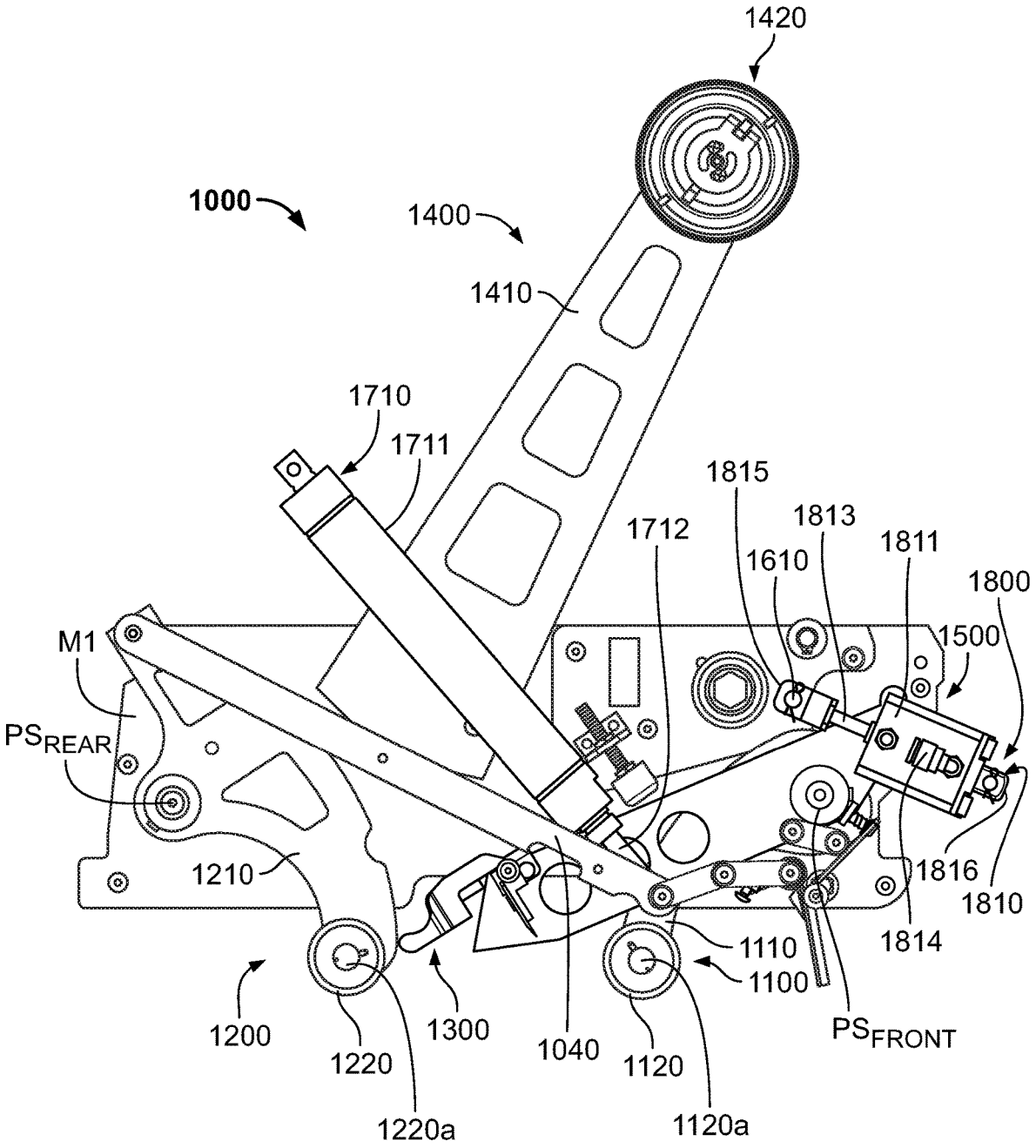

The front roller assembly 1100 includes a front roller arm 1110 and a front roller 1120. The front roller arm 1110 is pivotably mounted to the first mounting plate M1 via a front roller-arm-pivot shaft $PS_{FRONT}$ so the front roller arm 1110 can pivot relative to the mounting plate M1 about an axis $A_{FRONT}$ between a front roller arm extended position (FIGS. 6A-6C) and a front roller arm retracted position (FIG. 6D). The front roller arm 1110 includes a front roller-mounting shaft 1120*a*, and the front roller 1120 is rotatably mounted to the front roller-mounting shaft 1120*a* so the front roller 1120 can rotate relative to the front roller-mounting shaft 1120*a*.

The rear roller assembly 1200 includes a rear roller arm 1210 and a rear roller 1220. The rear roller arm 1210 is pivotably mounted to the first mounting plate M1 via a rear roller-arm-pivot shaft $PS_{REAR}$ so the rear roller arm 1210 can pivot relative to the mounting plate M1 about an axis $A_{REAR}$ between a rear roller arm extended position (FIGS. 6A-6C) and a rear roller arm retracted position (FIG. 6D). The rear roller arm 1210 includes a rear roller-mounting shaft 1220*a*, and the rear roller 1220 is rotatably mounted to the rear roller-mounting shaft 1220*a* so the rear roller 1220 can rotate relative to the rear roller-mounting shaft 1220*a*.

A rigid first linking member 1020 is attached to and extends between the first roller arm 1110 and the second roller arm 1210. The first linking member 1020 links the front and rear roller assemblies 1100 and 1200 so: (1) moving the front roller arm 1110 from the front roller arm extended position to the front roller arm retracted position causes the first linking member 1020 to force the rear roller arm 1210 to move from the rear roller arm extended position to the rear roller arm retracted position (and vice-versa); and (2) moving the rear roller arm 1210 from the rear roller arm extended position to the rear roller arm retracted position causes the first linking member 1020 to force the front roller arm 1110 to move from the front roller arm extended position to the front roller arm retracted position (and vice-versa).

The tape-cartridge-actuating assembly 1600 (FIG. 2) includes a first tape-cartridge valve 1000*v*1, a second tape-cartridge valve 1000*v*2, a roller-arm-actuating assembly 1700, and a cutter-arm-actuating assembly 1800. The first and second tape-cartridge valves 1000*v*1 and 1000*v*2 each include a solenoid valve fluidly connectable to a pressurized gas source and the roller-arm- and cutter-arm-actuating assemblies 1700 and 1800 (dashed lines in FIG. 2) and configured to direct pressurized gas into the roller-arm- and cutter-arm-actuating assemblies 1700 and 1800 (as described in detail below).

The roller-arm-actuating assembly 1700 is configured to move the linked front and rear roller arms 1110 and 1210 between their respective extended and retracted positions. As best shown in FIG. 6G, in this example embodiment the roller-arm-actuating assembly 1700 includes a support plate 1702 and a roller-arm actuator 1710 pivotably attached to the support plate 1702 via a pin assembly 1703. The roller-arm actuator 1710 includes a double-acting pneumatic cylinder comprising a cylinder 1711, a piston 1712 (not shown) slidably disposed in the cylinder 1711, a piston rod 1713 having one end attached to the piston 1712 and an opposite end external to the cylinder 1711, a first connector (not shown) that enables pressurized gas to be introduced into the cylinder 1711 on a first side of the piston 1712, and a second connector 1714 that enables pressurized gas to be introduced into the cylinder 1711 on a second opposite side of the piston 1712.

The piston 1712 is movable within the cylinder 1711 between: (1) a first position in which the piston 1712 is positioned near a first, bottom end of the cylinder 1711 and the piston rod 1713 is in an extended position; and (2) a second position in which the piston 1712 is positioned near a second, top end of the cylinder 1711 and the piston rod 1713 is in a retracted position. Introduction of pressurized gas into the first connector causes the piston 1712 to move to the second position to retract the piston rod 1713, and introduction of pressurized gas into the second connector 1714 causes the piston to move to the first position to extend the piston rod 1713. In other embodiments the roller-arm actuator may include any other actuator, such as a double-acting hydraulic cylinder or a motor.

The roller-arm actuator 1710 is operably connected to the front roller assembly 1100 to control movement of the front roller arm 1110 and the rear roller arm 1210 linked to the front roller arm 1110 between their respective extended and retracted positions. More specifically, the roller-arm actuator 1710 is coupled between the mounting plate M2 and the first roller arm assembly 1100 via attachment of the support plate 1702 to the mounting plate M2 and attachment of the end of the piston rod 1713 external to the cylinder 1711 to the shaft 1130 of the front roller assembly 1100. In this configuration, when the piston 1712 is in the first position and the piston rod 1713 is thus in the extended position, the front and rear roller arms 1110 and 1210 are in their respective extended positions. Movement of the piston 1712 from the first position to the second position retracts the piston rod 1713, which pulls the shaft 1130 toward the cylinder 1711 and in doing so causes the front roller arm 1110 and the rear roller arm 1210 (via the first linking member 1020) to move to their respective retracted positions.

The first tape-cartridge valve 1000*v*1 is in fluid communication with the first connector of the roller-arm actuator 1710, and the second tape-cartridge valve 1000*v*2 is in fluid communication with the second connector 1714 of the roller-arm actuator 1710. The controller 90 is operably connected to the first and second tape-cartridge valves 1000*v*1 and 1000*v*2 and configured to control the roller-arm actuator 1710 (and therefore the positions of the front and rear roller arms 1110 and 1210) by controlling air flow through the first and second tape-cartridge valves 1000*v*1 and 1000*v*2. Specifically, the controller 90 is configured to open the first tape-cartridge valve 1000*v*1 (while closing or maintaining closed the second tape-cartridge valve 1000*v*2) to direct pressurized gas into the cylinder 1711 via the first connector to cause the piston rod 1713 to retract, which causes the front roller arm 1110 and the rear roller arm 1210 (via the first linking member 1020) to move to their respective retracted positions. Conversely, the controller 90 is configured to open the second tape-cartridge valve 1000*v*2 (while closing or maintaining closed the first tape-cartridge valve 1000*v*1) to direct pressurized gas into the cylinder 1711 via the second connector 1714 to cause the piston rod 1713 to extend, which causes the front roller arm 1110 and the rear roller arm 1210 (via the first linking member 1020) to move to their respective extended positions.

Figure 6E:
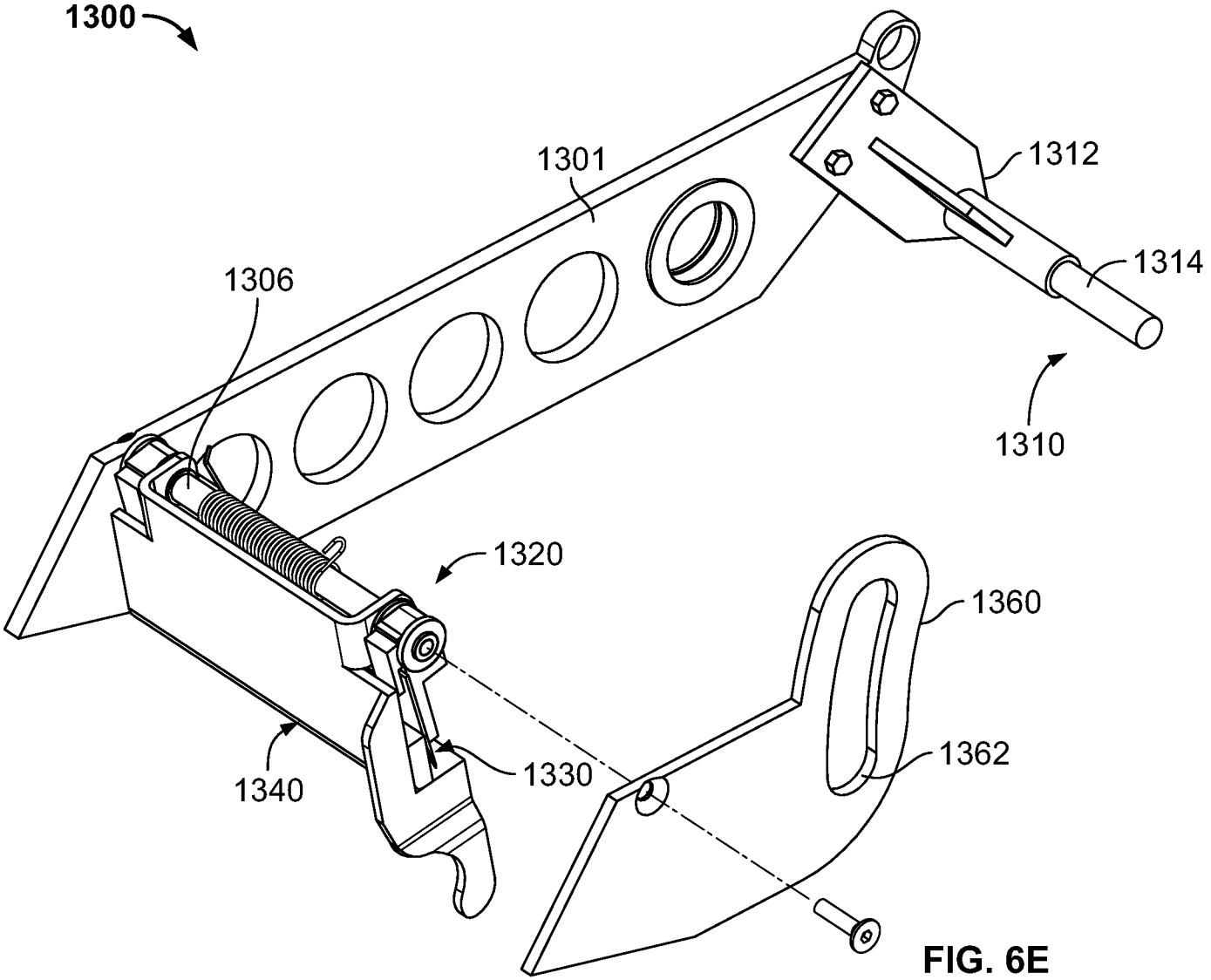
Figure 6F:
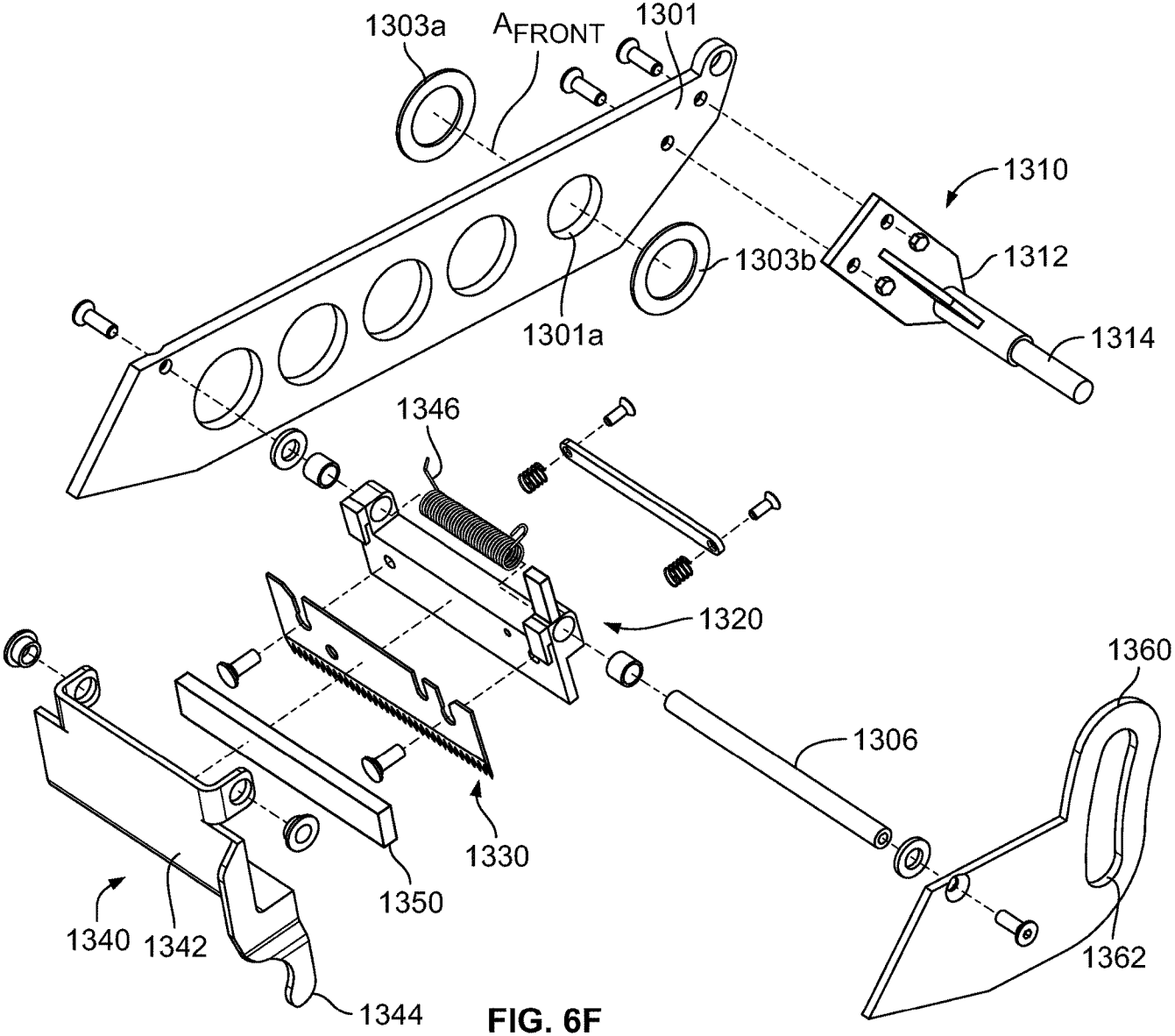

As best shown in FIGS. 6E and 6F, the cutter assembly 1300 includes a cutter arm 1301, a cutting-device cover pivot shaft 1306, a cutter-arm-actuator-coupling element 1310, a cutting-device-mounting assembly 1320, a cutting device 1330 including a toothed blade (not labeled) configured to sever tape, a cutting-device cover 1340, a cutting-device pad 1350, and a rotation-control plate 1360.

The cutter arm 1301 includes a cylindrical surface 1301*a* that defines a cutter arm mounting opening. The cutter arm 1301 is pivotably mounted (via the cutter arm mounting opening) to the first mounting plate M1 via the front roller-arm-pivot shaft $PS_{FRONT}$ and bushings 1303*a* and 1303*b* so the cutter arm 1301 can pivot relative to the mounting plate M1 about the axis $A_{FRONT}$ between a cutter arm extended position (FIGS. 6A-6C) and a cutter arm retracted position (FIG. 6D).

The cutter-arm-actuator-coupling element 1310 includes a support plate 1312 and a coupling shaft 1314 extending transversely from the support plate 1312. The support plate 1312 is fixedly attached to the cutter arm 1301 via fasteners 1316 so the coupling shaft 1314 is generally parallel to and coplanar with the axis $A_{FRONT}$.

The cutting-device-mounting assembly 1320 is fixedly mounted to the support arm 1310 (such as via welding) and is configured to removably receive the cutting device 1330. That is, the cutting-device-mounting assembly 1320 is configured so the cutting device can be removably mounted to the cutting-device-mounting assembly 1320. The cutting-device-mounting assembly 1320 is described in U.S. Pat. No. 8,079,395 (the entire contents of which are incorporated herein by reference), though any other suitable cutting-device-mounting assembly may be used to support the cutting device 1330.

The cutting-device cover 1340 includes a body 1342 and a finger 1344 extending from the body 1342. A pad 1350 is attached to the body 1342. The cutting-device cover 1340 is pivotably mounted to the support arm 1310 via mounting openings (not labeled) and the cutting-device cover pivot shaft 1306. Once attached, the cutting-device cover 1340 is pivotable about the axis $A_{COVER}$ relative to the cutter arm 1301 and the cutting device mount 1320 from front to back and back to front between a closed position and an open position. A cutting-device cover biasing element 1346, which includes a torsion spring in this example embodiment, biases the cutting-device cover 1340 to the closed position. When in the closed position, the cutting-device cover 1340 generally encloses the cutting device 1330 so the pad 1350 contacts the toothed blade of the cutting device 1330. When in the open position, the cutting-device cover 1340 exposes the cutting device 1330 and its toothed blade.

The cutting-device cover pivot shaft 1306 is also attached to the rotation-control plate 1360. The rotation-control plate 1360 includes a slot-defining surface 1362 that defines a slot. The surface 1362 acts as a guide (not shown) for a bushing that is attached to the mounting plate M2. The bushing provides lateral support for the cutter assembly 1300 to generally prevent the cutter assembly from moving toward or away from the mounting plates M1 and M2 and interfering with other components of the tape cartridge 1000 when in use.

Figure 6H:
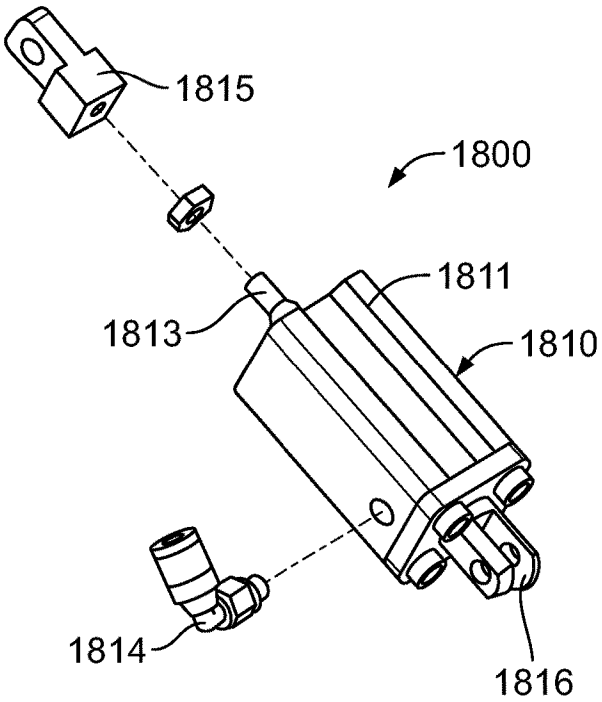
Figure 6G:
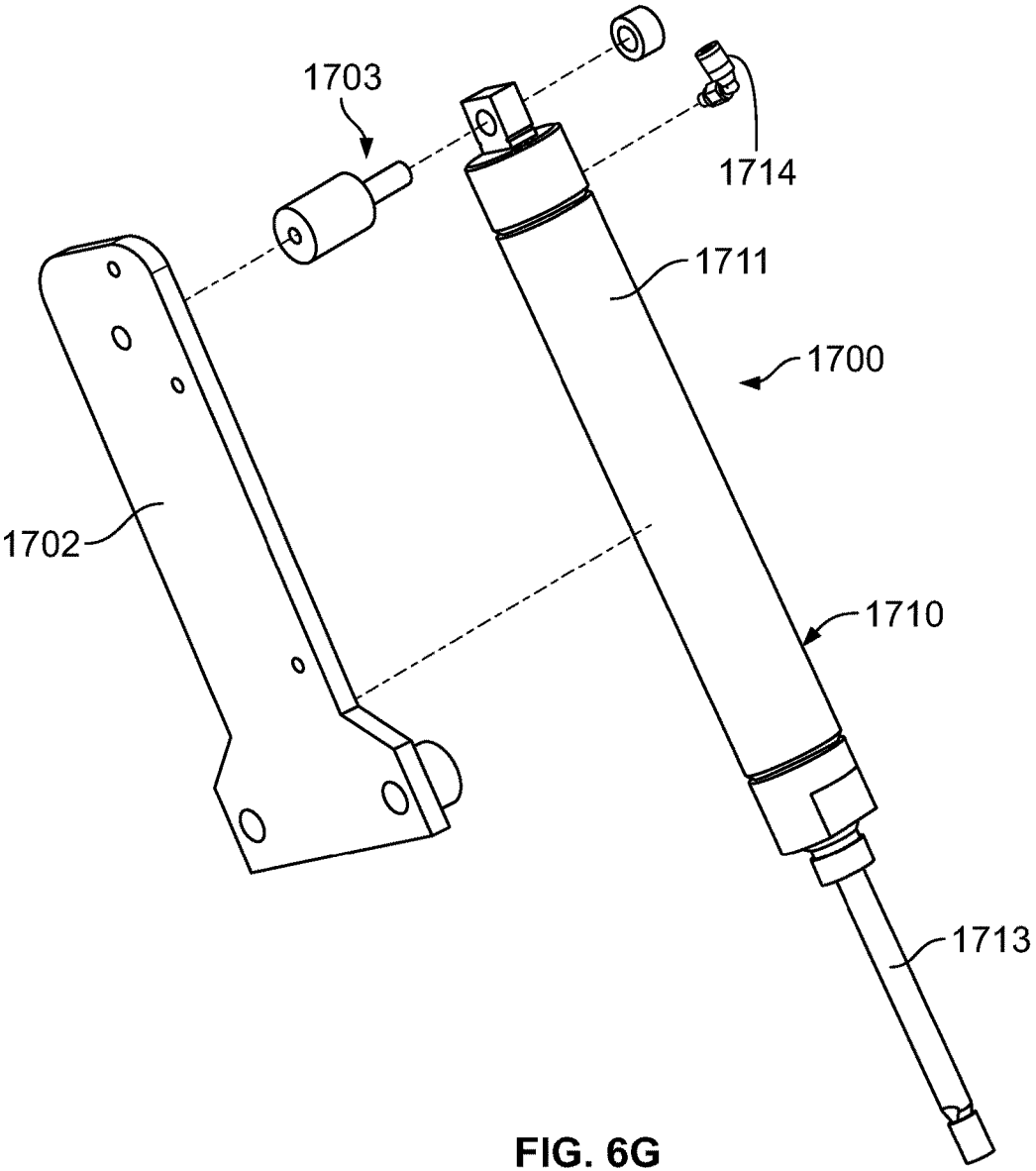
Figure 7A:
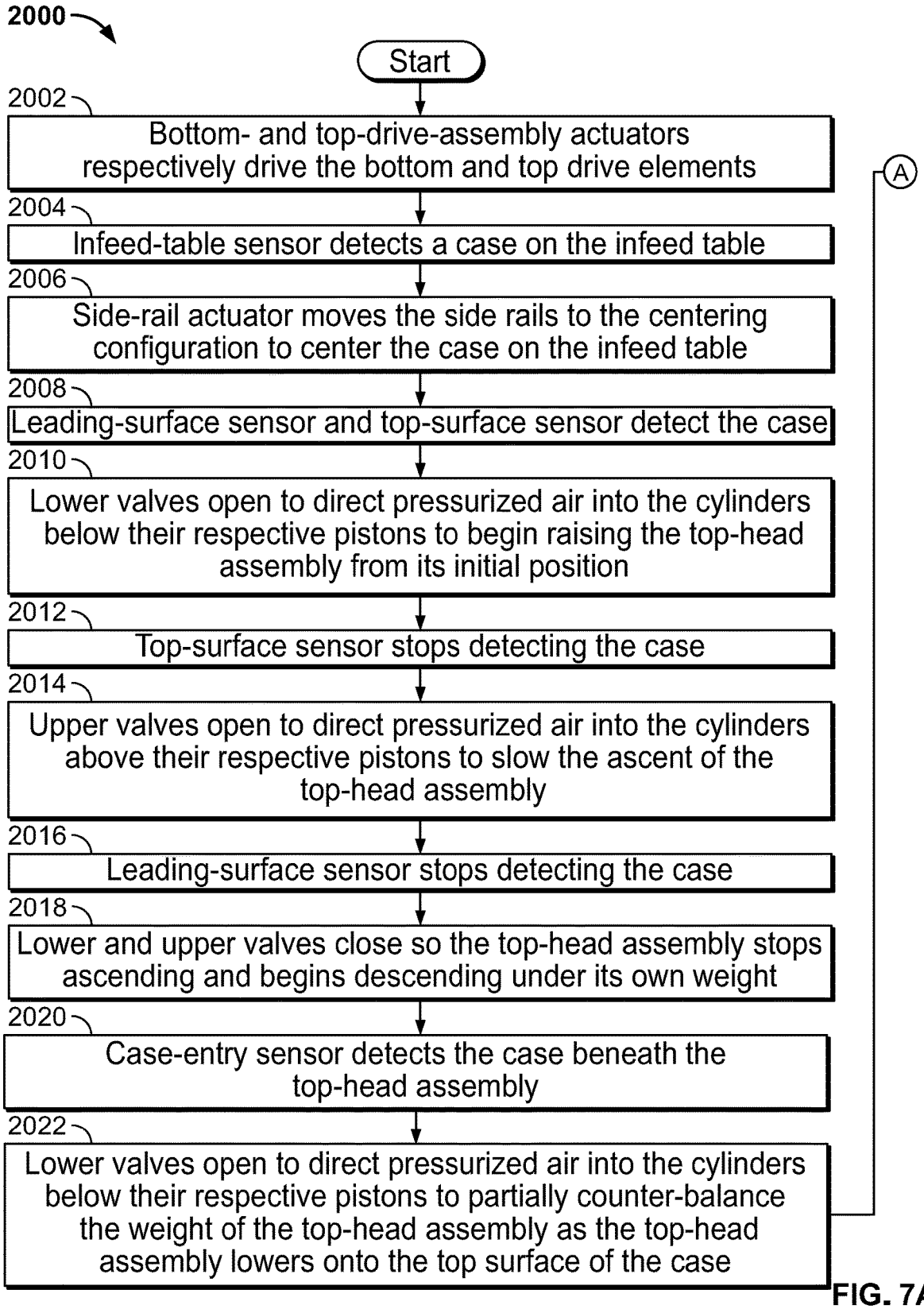
FIGS. 7A and 7B are a flowchart showing one example method of operating the case sealer of FIG. 1 to seal a case.
Figure 7B:
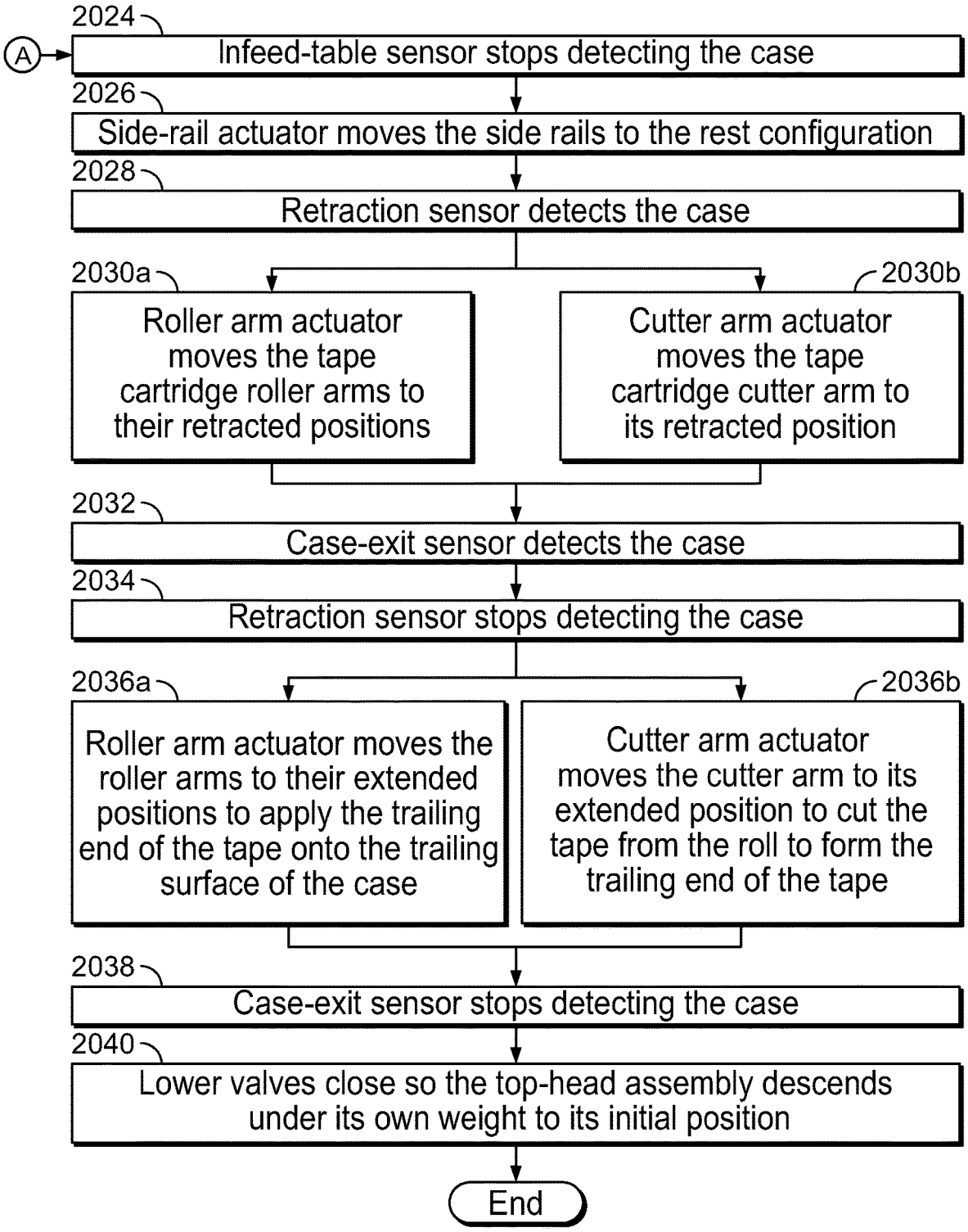

The cutter-arm-actuating assembly 1800 is configured to move the cutter arm 1301 between its retracted position and its extended position. As best shown in FIG. 6H, in this example embodiment the cutter-arm-actuating assembly 1800 includes a cutter-arm actuator 1810. The cutter-arm actuator 1810 includes a double-acting pneumatic cylinder including a cylinder 1811, a piston 1812 (not shown) slidably disposed in the cylinder 1811, a piston rod 1813 having one end attached to the piston 1812 and an opposite end external to the cylinder 1811, a first connector 1814 that enables pressurized gas to be introduced into the cylinder 1811 on a first side of the piston 1812, and a second connector (not shown) that enables pressurized gas to be introduced into the cylinder 1811 on a second opposite side of the piston 1812.

The piston 1812 is movable within the cylinder 1811 between: (1) a first position in which the piston 1812 is positioned near a first, top end of the cylinder 1811 and the piston rod 1813 is in an extended position; and (2) a second position in which the piston 1812 is positioned near a second, bottom end of the cylinder 1811 and the piston rod 1813 is in a retracted position. Introduction of pressurized gas into the first connector 1814 causes the piston 1812 to move to the first position to extend the piston rod 1813, and introduction of pressurized gas into the second connector causes the piston to move to the second position to retract the piston rod. In other embodiments the cutter-arm actuator may include any other actuator, such as a double-acting hydraulic cylinder or a motor.

The cutter-arm actuator 1810 is operably connected to the cutter assembly 1300 to control movement of the cutter arm 1301 from its retracted position to its extended position. More specifically, the cutter-arm actuator 1810 is coupled between the mounting plate M1 and the cutter assembly 1300 via attachment of a block 1815 at the end of the piston rod 1813 opposite the piston to the shaft 1610 and attachment of a block 1816 on the opposite end of the cylinder 1811 to the coupling shaft 1314 of the cutter-arm-actuator-coupling element 1310. In this configuration, when the piston 1812 is in the first position and the piston rod 1813 is thus in the extended position, the cutter arm 1301 is in its retracted position. Movement of the piston 1812 from the first position to the second position retracts the piston rod 1813, which causes the cylinder 1811 to move toward the shaft 1610, and in doing so pulls the coupling shaft 1314 toward the shaft 1610 and thus causes the cutter arm 1301 to move to its extended position.

The first tape-cartridge valve 1000*v*1 is in fluid communication with the first connector 1812 of the cutter-arm actuator 1810, and the second tape-cartridge valve 1000*v*2 is in fluid communication with the second connector of the cutter-arm actuator 1810. The controller 90 is operably connected to the first and second tape-cartridge valves 1000*v*1 and 1000*v*2 and configured to control the cutter-arm actuator 1810 (and therefore the position of the cutter arm 1301) by controlling air flow through the first and second tape-cartridge valves 1000*v*1 and 1000*v*2. Specifically, the controller 90 is configured to open the first tape-cartridge valve 1000*v*1 (while closing or maintaining closed the second tape-cartridge valve 1000*v*2) to direct pressurized gas into the cylinder 1811 via the first connector 1814 to cause the piston rod 1813 to extend, which causes the cutter arm 1301 to move to its retracted position. Conversely, the controller 90 is configured to open the second tape-cartridge valve 1000*v*2 (while closing or maintaining closed the first tape-cartridge valve 1000*v*1) to direct pressurized gas into the cylinder 1811 via the second connector to cause the piston rod 1813 to retract, which causes the cutter arm 1301 to move to its extended position.

The tape-mounting assembly 1400 includes a tape-mounting plate 1410 and a tape-core-mounting assembly 1420 rotatably mounted to the tape-mounting plate 1410. The tape-core-mounting assembly 1420 is further described in U.S. Pat. No. 7,819,357, the entire contents of which are incorporated herein by reference (though other tape core mounting assemblies may be used in other embodiments). A roll R of tape is mountable to the tape-core-mounting assembly 1420.

The tension-roller assembly 1500 includes several rollers (not labeled) rotatably disposed on shafts that are supported by the first mounting plate M1. A free end of the roll R of tape mounted to the tape-core-mounting assembly 1420 is threadable through the rollers until the free end is adjacent the front roller 1120 of the front-roller assembly 1110 with its adhesive side facing outward in preparation for adhesion to a case. The tension-roller assembly 1500 is further described in U.S. Pat. No. 7,937,905, the entire contents of which are incorporated herein by reference (though other tension roller assemblies may be used in other embodiments).

Operation of the case sealer 10 to seal a case C is now described with reference to the flowchart shown in FIG. 7, which shows a method 2000 of operating the case sealer 10, and FIGS. 8A-8F, which show the case sealer 10 along with a diagrammatic view of the first top-head-actuating-assembly pneumatic cylinder 248, the top-head assembly 300, the first top-head-actuating-assembly upper and lower valves 230*uv* and 2301*v*, and the pressurized gas source (here, a pressurized air source).

Initially, the top-head assembly 300 is at its initial (lower) position, and the side rails 114*a* and 114*b* are in their rest configuration. The controller 90 controls the bottom-drive-assembly actuator 118 and the top-drive-assembly actuator 322 to drive the bottom drive element of the base assembly 100 and the top-drive element of the top-head assembly, respectively, as block 2002 indicates.

Figure 8A:
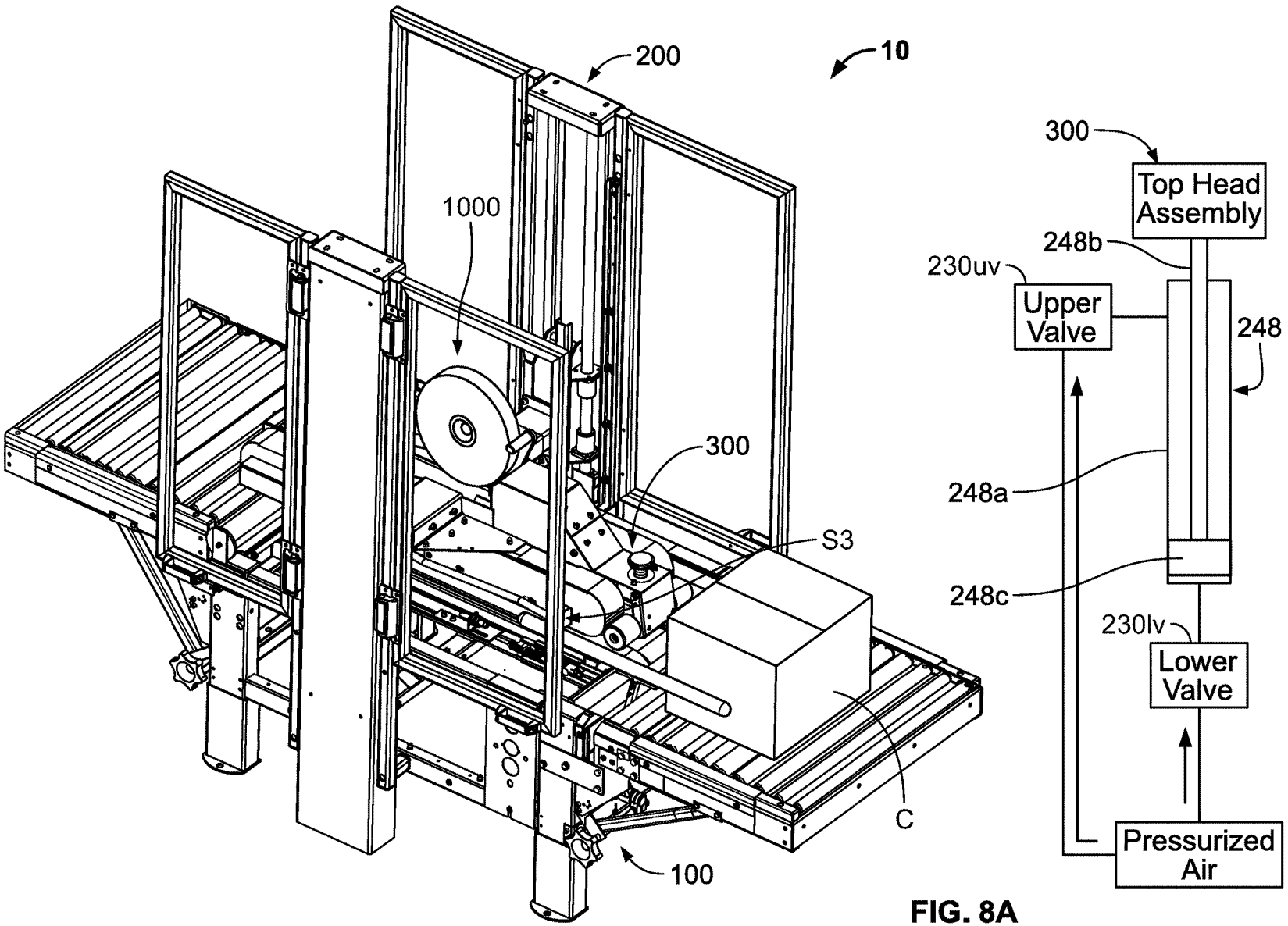
FIGS. 8A-8F are perspective views of the case sealer of FIG. 1 along with diagrammatic views of certain components of the first top-head-actuating assembly of FIG. 4B as the case sealer operates to seal a case.

The operator positions the case C onto the infeed table 112, and the infeed-table sensor S1 detects the presence of the case C, as block 2004 indicates, and in response sends a corresponding signal to the controller 90. Responsive to receiving that signal, the controller 90 controls the side-rail valve 117*a* to direct pressurized gas into the side-rail pneumatic cylinder 117*b* on the appropriate side of the piston to cause the side-rail pneumatic cylinder 117*b* to move the side rails 114*a* and 114*b* from the rest configuration to the centering configuration so the side rails 114*a* and 114*b* move laterally inward to engage and center the case C on the infeed table 112, as block 2006 indicates and as shown in FIG. 8A.

Figure 8B:
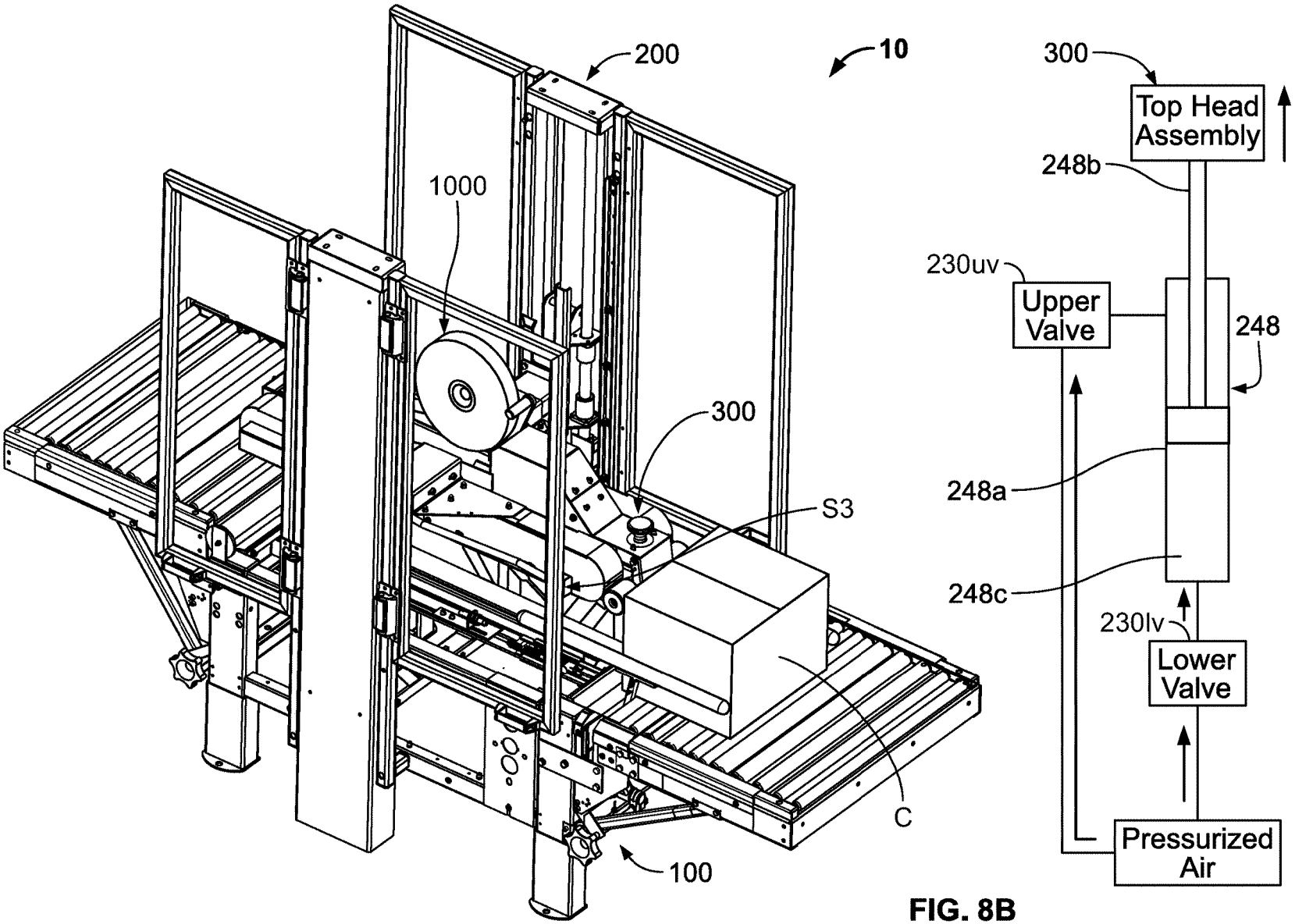

The operator then moves the case C into contact with the leading-surface sensor S2. This causes the leading-surface sensor S2 (via the case C contacting and actuating the paddle switch of the leading-surface sensor S2) and the top-surface sensor S3 (via the case moving within a designated distance of the top-surface proximity sensor S3) to detect the case C, as block 2008 indicates, and in response send corresponding signals to the controller 90. Responsive to receiving those signals, the controller 90 controls the first and second top-head-actuating assemblies 230 and 270 to begin moving the top-head assembly 300 upward at a first speed, which is a maximum speed in this example embodiment. Specifically, the controller 90 is configured to control the first and second top-head-actuating-assembly lower valves 2301*v* and 2701*v* to direct pressurized gas into the lower ports of the cylinders 248*a* and 288*a* to pressurize the volumes below their respective pistons 248*c* and 288*c* to a first pressure to cause their respective pistons 248*c* and 288*c* to move upward and extend their respective piston rods 248*b* and 288*b* to move the top-head assembly 300 upward at the first speed, as block 2010 indicates and as shown in FIG. 8B.

Figure 8C:
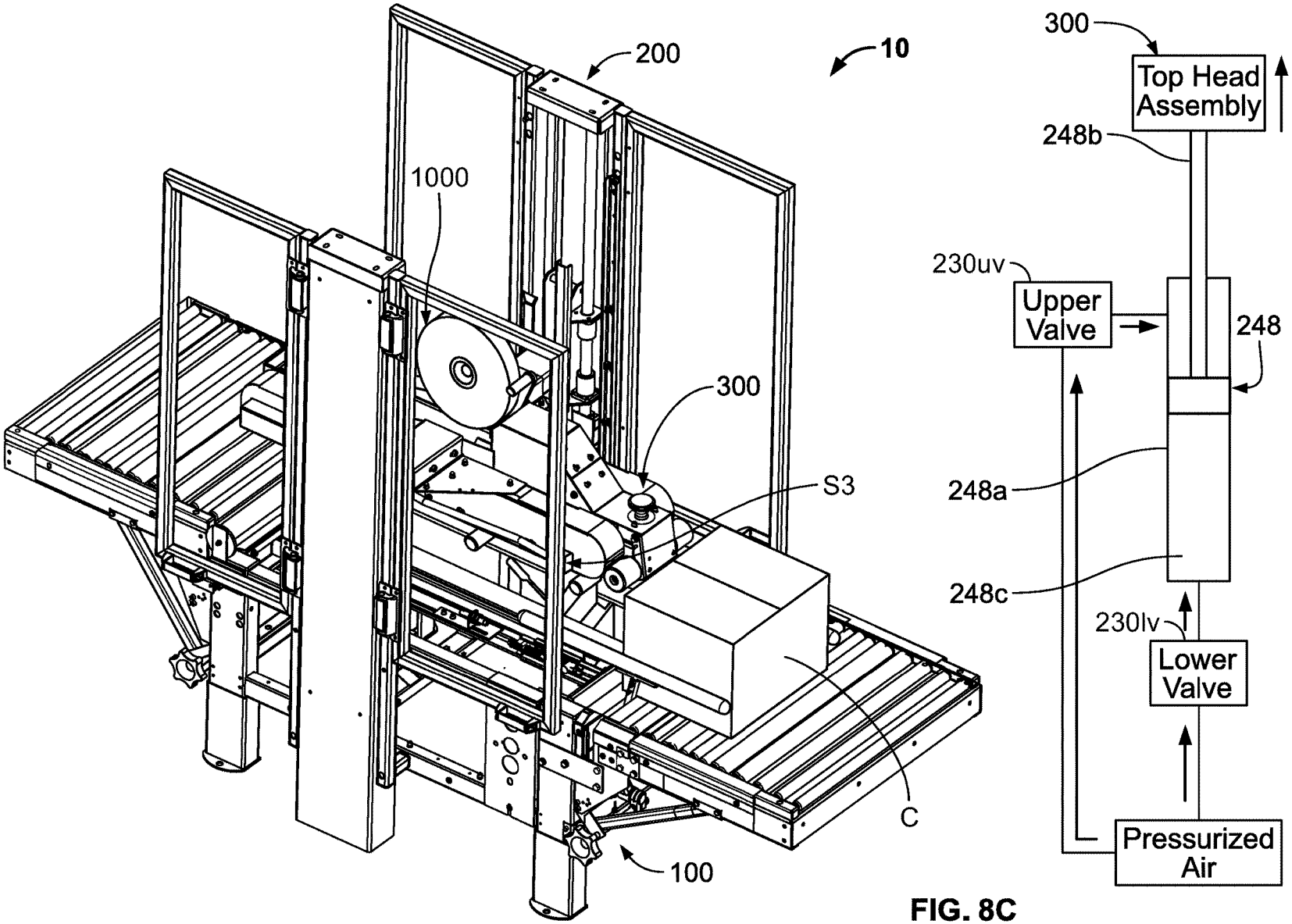

The top-head assembly 300 continues moving upward at the first speed, and the top-surface sensor S3 eventually stops detecting the case C, as block 2012 indicates. This indicates that the top-surface sensor S3 has ascended above the top surface of the case C. At this point, the leading-surface sensor S2 continues to detect the case (i.e., the leading surface of the case C continues to actuate the paddle switch in this example embodiment). In response to no longer detecting the case C, the top-surface sensor S3 sends a corresponding signal to the controller 90. Responsive to receiving that signal, the controller 90 controls the first and second top-head-actuating assemblies 230 and 270 to begin slowing the upward movement of the top-head assembly 300. Specifically, the controller 90 controls the first and second top-head-actuating-assembly upper valves 230*uv* and 270*uv* to direct pressurized gas into the upper ports of the cylinders 248*a* and 288*a*, as block 2014 indicates and as shown in FIG. 8C, to pressurize the volumes above their respective pistons 248*c* and 288*c* to a second pressure that is less than the first pressure. The pressurized gas above the respective pistons 248*c* and 288*c* partially counteracts the upward force supplied by the pressurized gas below the pistons and therefore slows the upward movement of the top-head assembly 300 to a second speed that is lower than the first speed. That is, since the first pressure of the pressurized gas below the pistons is high enough to overcome both the weight of the top-head assembly 300 and the pressurized gas above the pistons, the top-head assembly 300 continues ascending (albeit at a slower speed).

Figure 8D:
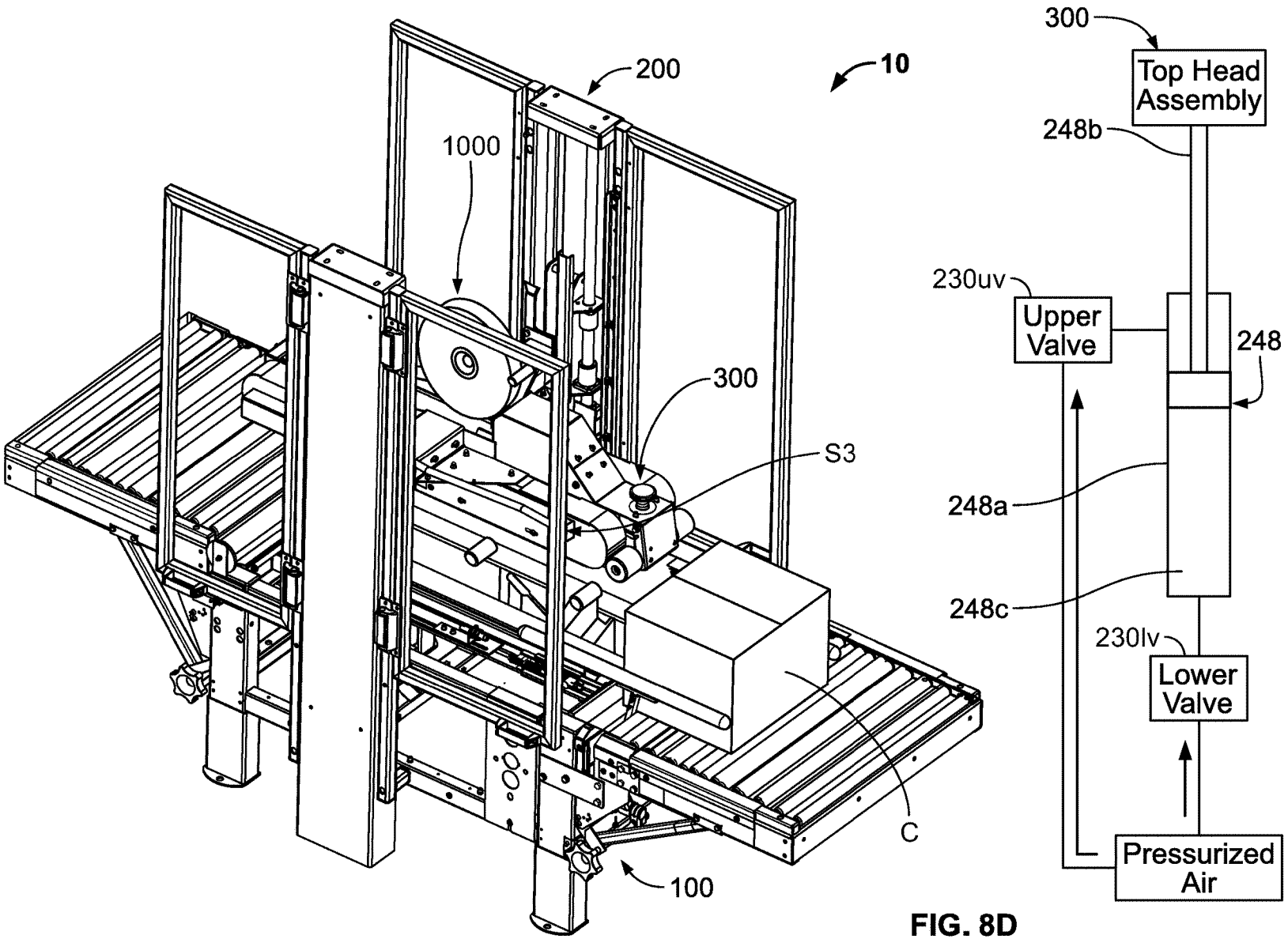

The top-head assembly 300 continues moving upward at this slower second speed, and the leading-surface sensor S2 eventually stops detecting the case C, as block 2016 indicates. This indicates that the top-head assembly 300 has ascended above the top surface of the case C. In response to no longer detecting the case C, the leading-surface sensor S2 sends a corresponding signal to the controller 90. Responsive to receiving that signal, the controller 90 controls the first and second top-head-actuating assemblies 230 and 270 to enable the top-head assembly 300 to stop its ascent and begin descending under its own weight. Specifically, the controller 90 controls the first and second lower valves 2301*v* and 2701*v* and the first and second top-head-actuating-assembly upper valves 230*uv* and 270*uv* to close, as block 2018 indicates and as shown in FIG. 8D. This depressurizes the first and second top-head-assembly pneumatic cylinders 248 and 288 so the weight of the top-head assembly 300 causes the top-head assembly 300 to stop moving upward and to begin descending. Any gas remaining in the first and second top-head-assembly pneumatic cylinders below their respective pistons vents to atmosphere as the top-head assembly 300 descends.

Figure 8E:
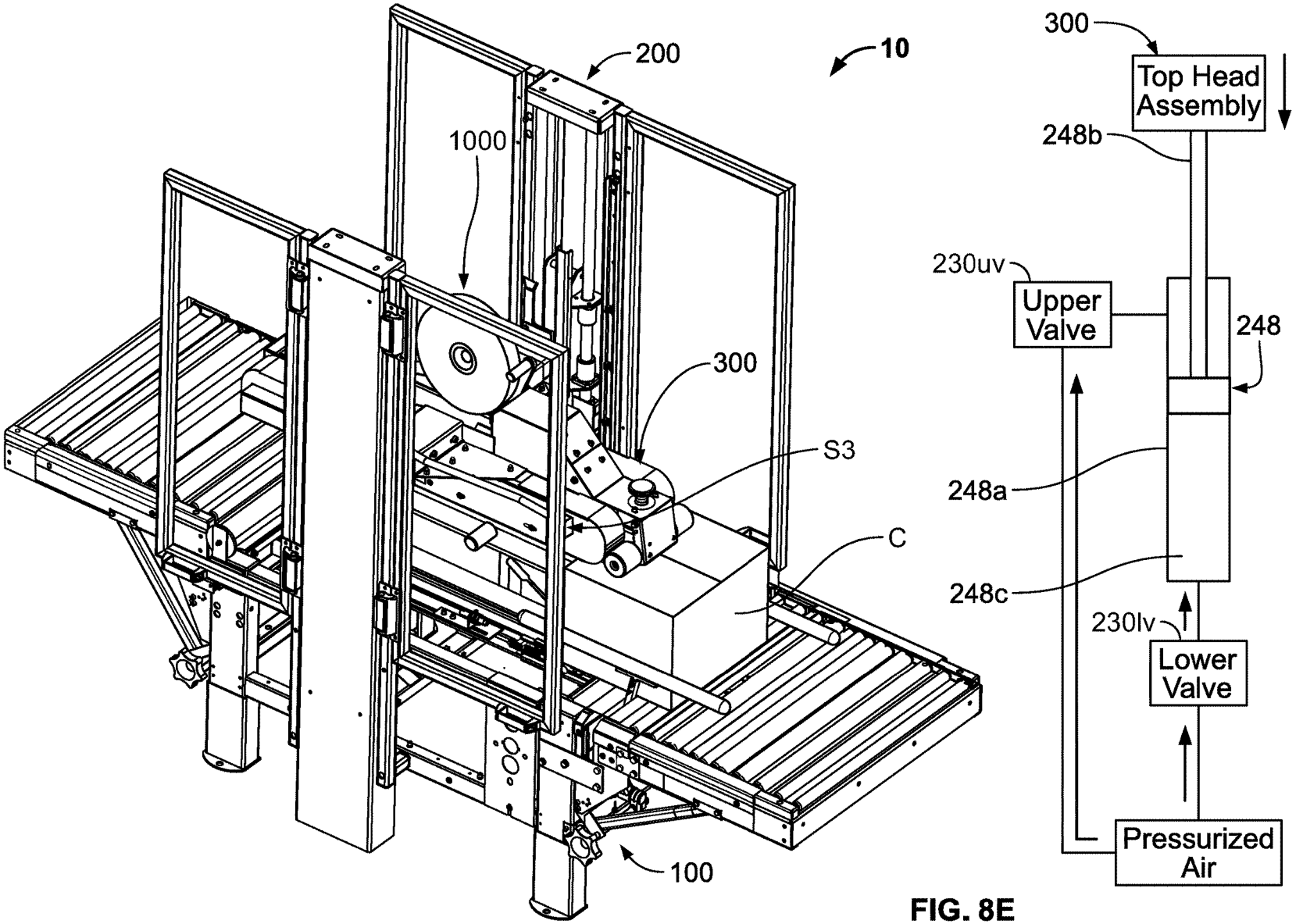

Once the top-head assembly 300 ascends above the top surface of the case C, the operator moves the case C beneath the top-head assembly 300 and into contact with the bottom-drive assembly 115. The case-entry sensor S4 detects the presence of the case C beneath the top-head assembly 300 and in response sends a corresponding signal to the controller 90, as block 2020 indicates. Responsive to receiving that signal, the controller 90 controls the first and second top-head-actuating assemblies 230 and 270 to begin to slow the descent of the top-head assembly 300 (which at this point is descending under its own weight). Specifically, the controller 90 controls the first and second top-head-actuating-assembly lower valves 2301*v* and 2701*v* to direct pressurized gas into the lower ports of the cylinders 248*a* and 288*a* to pressurize the volumes below their respective pistons 248*c* and 288*c* to a third pressure (that is less than the first pressure) to partially counter-balance the weight of the top-head assembly 300 and slow its descent onto the top surface of the case so as to not damage the case, as block 2022 indicates and as shown in FIG. 8E. That is, since the third pressure of the pressurized gas below the pistons is too low to completely counteract the weight of the top-head assembly 300, the top-head assembly 300 continues descending (albeit at a slower speed).

More generally, the controller 90 is configured to control the top-head-actuating-assembly actuators 248 and 288 to: (1) raise the top-head assembly 300 at a first speed responsive to the leading-surface sensor S2 and the top-surface sensor S3 detecting the case; (2) continue raising the top-head assembly 300 at a second slower speed responsive to the top-surface sensor S3 no longer detecting the case and the leading-surface sensor S2 still detecting the case; (3) enable gravity to stop and begin lowering the top-head assembly 300 responsive to the leading-surface sensor S2 no longer detecting the case; and (4) partially counter-balance the weight of the top-head assembly 300 responsive to the case-entry sensor S4 detecting the case.

Figure 8F:
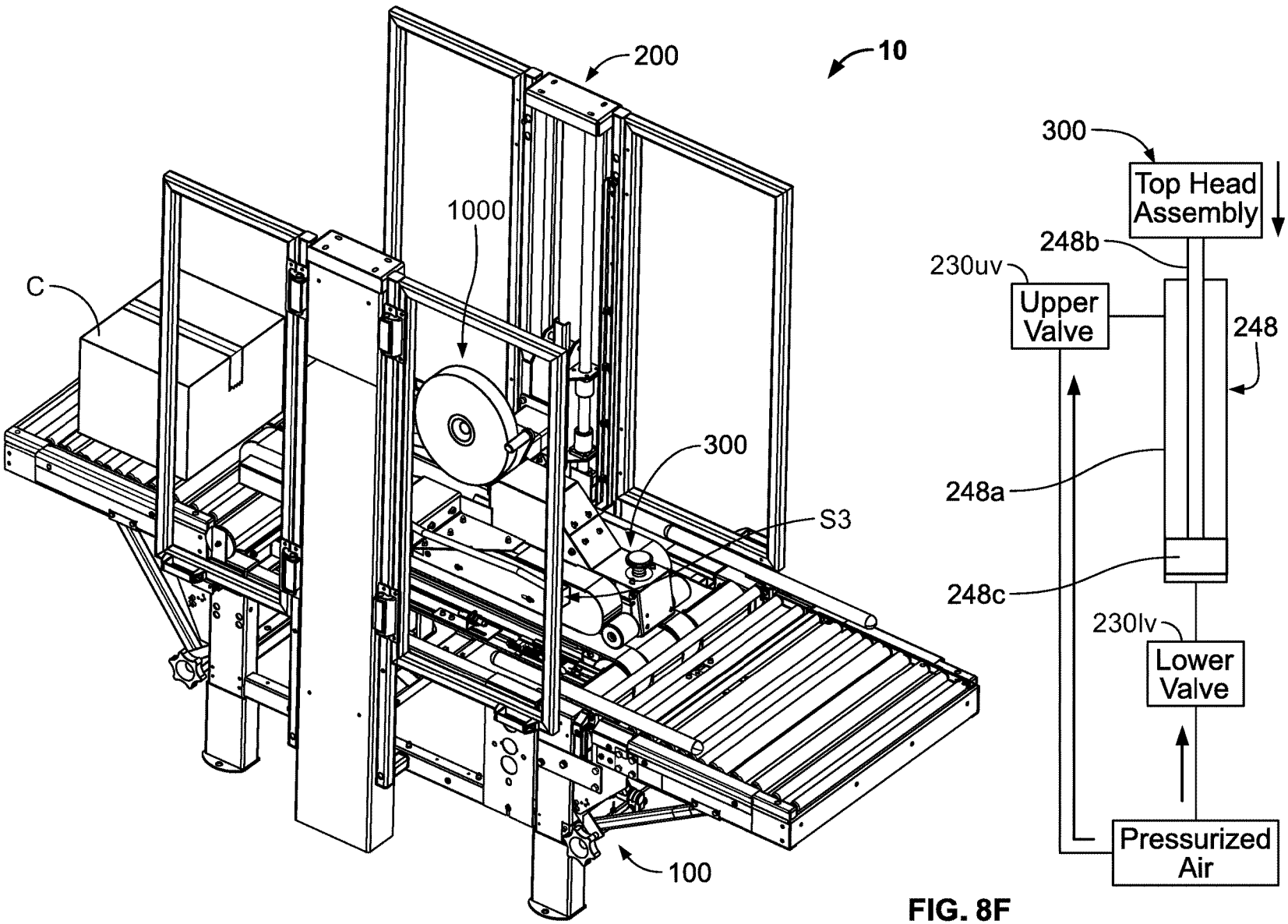

The top- and bottom-drive assemblies 320 and 115 begin moving the case C in the direction D. The case C eventually moves off of the infeed table 112, at which point the infeed-table sensor S1 stops detecting the case C and sends a corresponding signal to the controller 90, as block 2024 indicates. Responsive to receiving that signal, the controller 90 controls the side-rail valve 117*a* to direct pressurized gas into the side-rail pneumatic cylinder 117*b* on the opposite side of the piston to cause the side-rail pneumatic cylinder 117*b* to move the side rails 114*a* and 114*b* from the centering configuration to the rest configuration to make space on the infeed table 112 for the next case to-be-sealed, as block 2026 indicates and as shown in FIG. 8F.

The top- and bottom-drive assemblies 320 and 115 continue moving the case C, and just before the leading surface of the case C contacts the front roller 1120 of the tape cartridge 1000 the retraction sensor S5 detects the presence of the case C and in response sends a corresponding signal to the controller 90, as block 2028 indicates. Responsive to receiving that signal, the controller 90 controls the roller-arm actuator 1710 and the cutter-arm actuator 1810 to move the first and second roller arms 1110 and 1120 and the cutter arm 1301 to their respective retracted positions, as blocks 2030*a* and 2030*b* indicate. Specifically, the controller 90 opens the first tape-cartridge valve 1000*v*1 (while closing or maintaining closed the second tape-cartridge valve 1000*v*2), which directs pressurized gas: (1) into the cylinder 1711 via the first connector and causes the piston rod 1713 to retract, which causes the front roller arm 1110 and the rear roller arm 1210 (via the first linking member 1020) to move to their respective retracted positions shown in FIG. 6D; and (2) into the cylinder 1811 via the first connector 1814 and causes the piston rod 1813 to extend, which causes the cutter arm 1301 to move to its retracted position shown in FIG. 6D.

The leading surface of the case C contacts the front roller 1120 of the tape cartridge 1000 as the front roller arm 1110 is moving to its retracted position, which causes the tape positioned on the front roller 1120 to adhere to the leading surface of the case C. The fact that the front roller arm 1110 is moving toward its retracted position when the case C contacts the front roller 1120 reduces the force the front roller arm assembly 1100 imparts to the leading surface of the case C (compared to certain prior art case sealers), which reduces the likelihood that the roller arm assemblies will damage the case C during taping (compared to certain prior art tape cartridges that do not include actuators to retract the roller arms).

When the front and rear roller arms 1110 and 1210 are in their retracted positions, the front and rear rollers 1120 and 1220 are positioned so they apply enough pressure to the tape to adhere the tape to the top surface of the case C. When the cutter arm 1301 is in its retracted position, the cutter arm 1301 does not contact the top surface of the case C (though in certain embodiments it may do so). This significantly reduces the downward force applied to the top surface of the case C as compared to certain prior art tape cartridges that use biasing elements on their roller and/or cutter arms to pressure the arms against the top surface of the case C during taping. This reduces and virtually eliminates the possibility of the tape cartridges causing the top surface of the case to cave in and enables operators to use cases formed from weaker (and less expensive) corrugated and/or to fill cases with less protective dunnage (e.g., paper or bubble wrap) to save costs and reduce environmental waste without fear of the tape cartridge damaging the cases.

The controller 90 controls the first and second tape-cartridge valves 1000*v*1 and 1000*v*2 to remain open and closed, respectively, to retain the front and rear roller arms 1110 and 1210 and the cutter arm 1301 in their respective retracted positions as the top- and bottom-drive assemblies 320 and 115 move the case C past the tape cartridge 1000. At some point, the case-exit sensor S6 detects the presence of the case C, as block 2032 indicates (though this may occur after the retraction sensor S5 stops detecting the case C depending on the length of the case).

Once the retraction sensor S5 stops detecting the case (indicating that the case has moved past the retraction sensor S5), the retraction sensor S5 sends a corresponding signal to the controller 90, as block 2034 indicates. In response, the controller 90 controls the roller-arm actuator 1710 to return the first and second roller arms 1110 and 1120 to their respective extended positions to apply tape to the trailing surface of the case and controls the cutter-arm actuator 1810 to return the cutter arm 1301 to its extended position to cut the tape from the roll, as blocks 2036*a* and 2036*b* indicate. Specifically, the controller 90 closes the first tape-cartridge valve 1000*v*1 and opens the second tape-cartridge valve 1000*v*2, which directs pressurized gas: (1) into the cylinder 1711 via the second connector 1714 and causes the piston rod 1713 to extend, which causes the front roller arm 1110 and the rear roller arm 1210 (via the first linking member 1020) to move to their respective extended positions; and (2) into the cylinder 1811 via the second connector and causes the piston rod 1813 to retract, which causes the cutter arm 1301 to move to its extended position.

As this occurs, the finger 1344 of the cutting-device cover 1340 contacts the top surface of the case so the cutting-device cover 1340 pivots to the open position and exposes the cutting device 1330. Continued movement of the cutter arm 1301 brings the toothed blade of the cutting device 1330 into contact with the tape and severs the tape from the roll R. As the front and rear roller arms 1110 and 1210 move back to their extended positions, the rear roller arm 1210 moves so the rear roller 1220 contacts the severed end of the tape and applies the tape to the trailing surface of the case C to complete the taping process.

The top- and bottom-drive assemblies 320 and 115 continue to move the case C until it exits from beneath the top-head assembly 300 onto the outfeed table 113, at which point the case-exit sensor S6 stops detecting the case, as block 2038 indicates, and sends a corresponding signal to the controller 90. Responsive to receiving that signal, the controller 90 controls the first and second top-head-actuating assemblies 230 and 270 to enable the top-head assembly 300 to descend under its own weight. Specifically, the controller 90 controls the first and second top-head-actuating-assembly lower valves 2301*v* and 2701*v* to close, as block 2040 indicates and as shown in FIG. 8F. The weight of the top-head assembly 300 causes it to descend back to its initial position. Any gas remaining in the cylinders below their respective pistons vents to atmosphere as the top-head assembly 300 descends.

If the operator moves another case (such as a shorter case) below the top-head assembly 300 as the top-head assembly 300 is descending and the case-entry sensor S4 detects the presence of that case beneath the top-head assembly 300, the process re-starts at block 2020 (with the case-entry sensor S4 sending an appropriate signal to the controller 90) to seal that case.

The case sealer of the present disclosure solves the above-described problems and can seal under-filled or weak cases at higher throughput than prior art ransom case sealers. The ability of the top-head-actuating assemblies to vary the speed of the top-head assembly when ascending to make room for the case beneath the top-head assembly and when descending onto the case maximizes the speed of the top-head assembly while also limiting overshoot, which maximizes the efficiency at which the top-head assembly moves. This means that the ascent/descent movement cycle of the top-head assembly of the case sealer of the present disclosure is (collectively) faster than those of prior art case sealers. Additionally, use of the tape-cartridge-actuating assembly significantly reduces the forces applied to the leading and top surfaces of the case as compared to prior art tape cartridges that use biasing elements on their roller and/or cutter arms. This reduces and virtually eliminates the possibility of the tape cartridges causing the top surface of the case to cave in and enables operators to use cases formed from weaker (and less expensive) corrugated and/or to fill cases with less protective dunnage (e.g., paper or bubble wrap) without fear of the tape cartridge damaging the cases.

The double-acting pneumatic cylinders described above may be configured and oriented in any suitable manner to move the roller and/or cutter arms as desired on either the extension or retraction stroke.

The case sealer may be powered in any suitable manner. In the above-described example embodiments, electrical couplings and compressed air power the case sealer.

In other embodiments, the controller is configured to control the cutter arm actuator to return the cutter arm to its retracted position after cutting the tape. That is, in these embodiments, the default position for the cutter arm is its retracted position, and the controller is configured to control the cutter arm actuator to move from this position to the extended position (and then back to the retracted position) responsive to receiving a signal from the retraction sensor that the retraction sensor no longer detects the presence of the case.

In various embodiments, the cutter-arm assembly is mechanically linked to the front- and/or rear-roller assembly such that retraction of the front-(and/or rear-) roller arm causes retraction of the cutter arm and extension of the front-(and/or rear-) roller arm causes extension of the cutter arm. In these embodiments, the roller-arm-actuating assembly is configured to control movement of both the roller- and cutter-arm-actuating assemblies between their respective extended and retracted positions.

In certain embodiments, the controller is separate from and in addition to the sensors. In other embodiments, the sensors act as their own controllers. For instance, in one embodiment, the retraction sensor is configured to directly control the cutter and roller arm actuators responsive to detecting the presence of and the absence of the case, the infeed-table sensor is configured to directly control the side rail actuator responsive to detecting the presence of and the absence of the case, and the leading-surface and top-surface sensors are configured to directly control the top head actuator responsive to detecting the presence of and the absence of the case (or contact with the case).

In certain embodiments, the controller is configured to prevent vertical movement of the top-head assembly while the case is underneath the top-head assembly. In one such embodiment, the controller is configured to prevent vertical movement of the top-head assembly (i.e., is configured not to actuate the first or second top-head-actuating assemblies) during a period starting with the case-entry sensor detecting the case and ending with the case-exit sensor no longer detecting the case.

In other embodiments, once the leading-surface sensor stops detecting the case, rather than close the top-head-actuating-assembly upper valves along with the top-head-actuating-assembly lower valves, the controller leaves the top-head-actuating-assembly upper valves open to more quickly stop the ascent of the top-head assembly and speed the descent of the top-head assembly back toward the case. In one such embodiment, the controller is configured to close the top-head-actuating-assembly upper valves responsive to the case-entry sensor detecting the case.

In further embodiments, once the leading-surface sensor stops detecting the case, rather than close the top-head-actuating-assembly lower valves along with the top-head-actuating-assembly upper valves, the controller reduces the pressure below the respective pistons to the second pressure.

While the top-head-actuating-assembly actuators are pneumatic cylinders controlled via valves and pressurized gas in the above-described example embodiment, these actuators may be any other suitable actuators that may be operably connected to the top-head assembly to control vertical movement of the top head assembly as described above. For instance, in one embodiment, the rails are linear gears (or "racks") and the top-head-actuating-assembly actuators are electric motors operably connected to spur gears (or "pinions") supported by the carriages and meshed with the linear gears. In this embodiment, the controller is configured to control output of the motor—and therefore rotation of the spur gears—to move the top-head assembly. In another embodiment, the mast assembly comprises pulleys driven by a motor-driven jack shaft. In this embodiment, the top-head assembly is attached it a chain, belt, or other suitable component driven by the pulleys to move the top-head assembly.

In various embodiments, the case sealer includes an active braking system operably connectable to the top-head assembly and configured to slow the vertical movement of the top-head assembly from the first speed to the second speed. For instance, in one such embodiment, the controller is configured to, responsive to the top-surface sensor no longer detecting the case, activate the active braking system so a component of the active braking system moves into contact with the top-head assembly to slow the vertical movement of the top-head assembly.

The example embodiment of the case sealer described above and shown in the Figures is a semiautomatic case sealer in which an operator feeds closed cases beneath the top-head assembly. This is merely one example embodiment, and the case sealer may be any other suitable type of case sealer, such as an automatic case sealer in which a machine automatically feeds closed cases beneath the top-head assembly.

In other embodiments, the case sealer includes a measuring device (such as a height sensor) configured to determine the height of a case to-be-sealed before the case contacts the leading-surface sensor. In these embodiments, the controller uses the determined height of the case to control the appropriate valves to move the top-head assembly as desired. In other words, in these embodiments, the controller does not use feedback from a top-surface sensor to detect the top surface of the case as the top-head assembly ascends.

FIGS. 9A-9D illustrate another embodiment of the tape cartridge 3000 that includes biasing elements that bias the roller arms and the cutter arm to their respective extended positions. The biasing elements eliminate the need for direct actuation of the roller arms and the cutter arm from their respective retracted positions to their respective extended positions, as described in detail below. The same element numbering is used for components of the tape cartridge 3000 that are identical to those included in (and described above with respect to) the tape cartridge 1000. For clarity, components of the tape cartridge 3000 that are not included in the tape cartridge 1000 are identified using element numbers that begin with "3." For brevity, the below description of the tape cartridge 3000 focuses on the components not included in (and described above with respect to) the tape cartridge 1000.

Turning now to the additional components of the tape cartridge 3000, a first roller-arm-assembly-biasing element 3014*a*—here, an extension spring—has one end attached to a first roller-arm-assembly-biasing-element-attachment post 3014 attached to the first mounting plate M1 and another end attached to a connector 3016 pivotably attached to the rear roller arm 1210. The first roller-arm-assembly-biasing element 3014*a* biases the front and rear roller arms 1110 and 1210 (in part via the first linking member 1020) to their extended positions. This is one example manner of biasing the front and rear roller arms to their extended positions, and any other suitable arrangement of components and/or combination of components may be employed to do so.

Figure 9A:
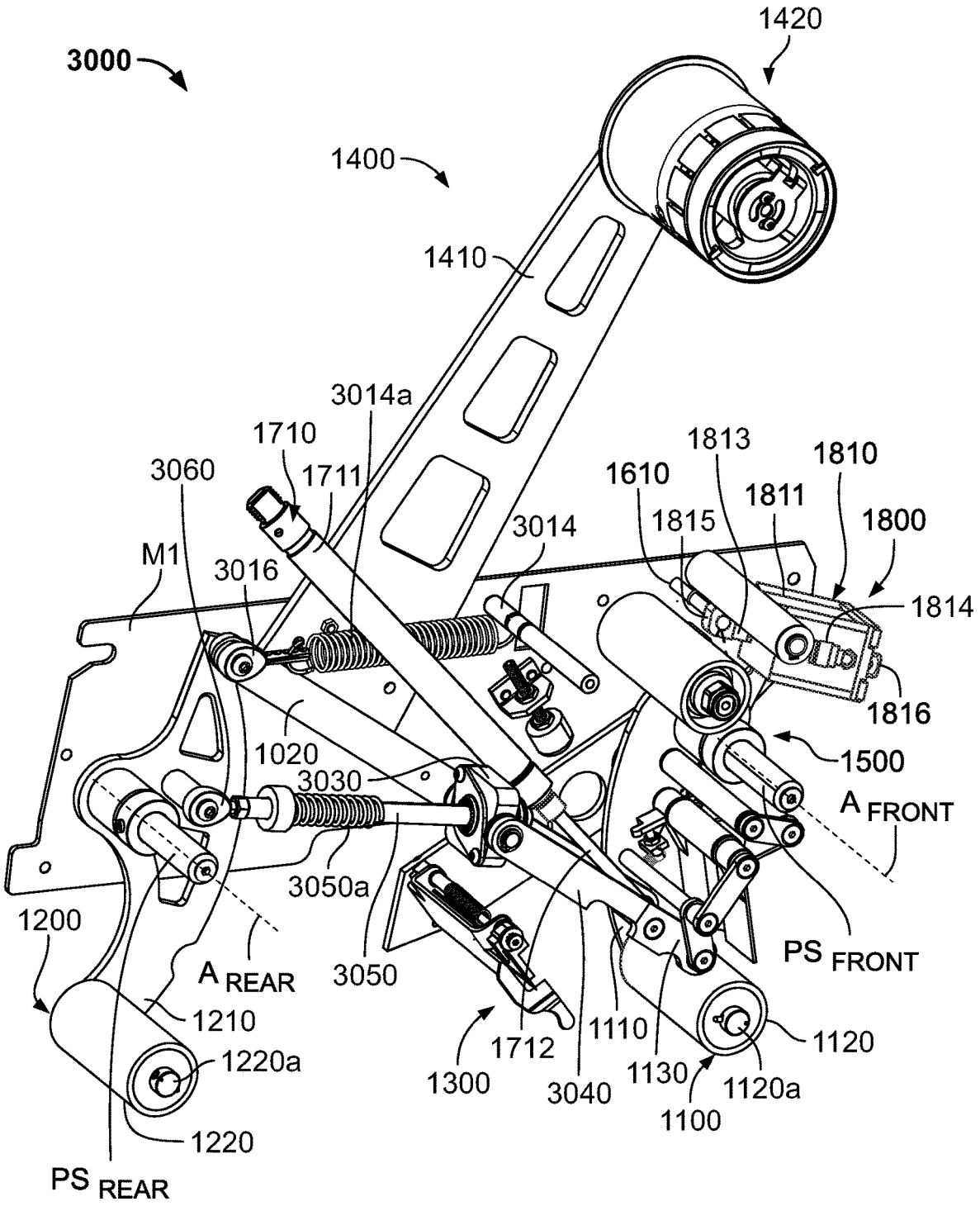
FIGS. 9A-9D are various views of another embodiment of the tape cartridge (and components thereof) of the present disclosure.
Figure 9B:
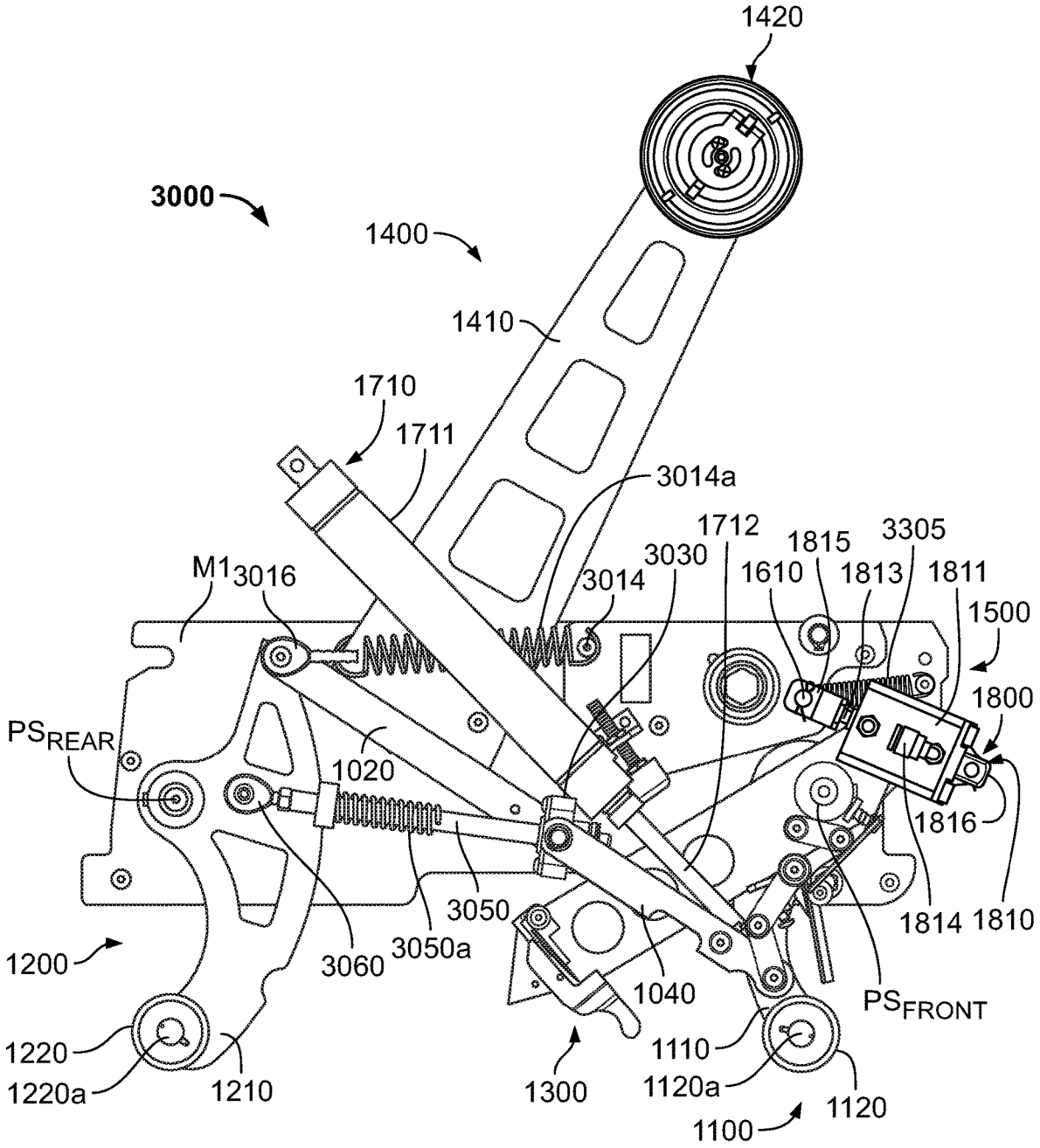
Figure 9C:
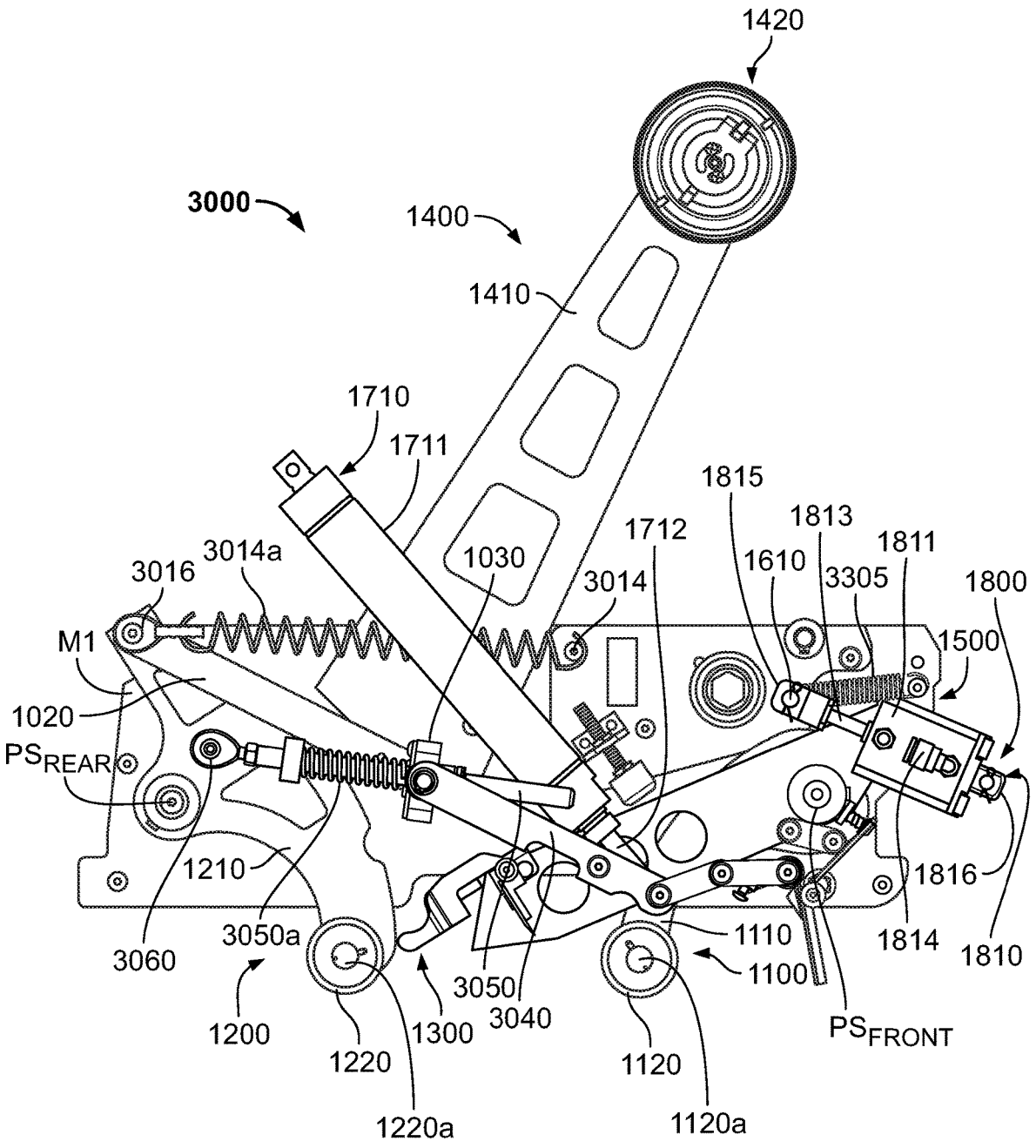
Figure 9D:
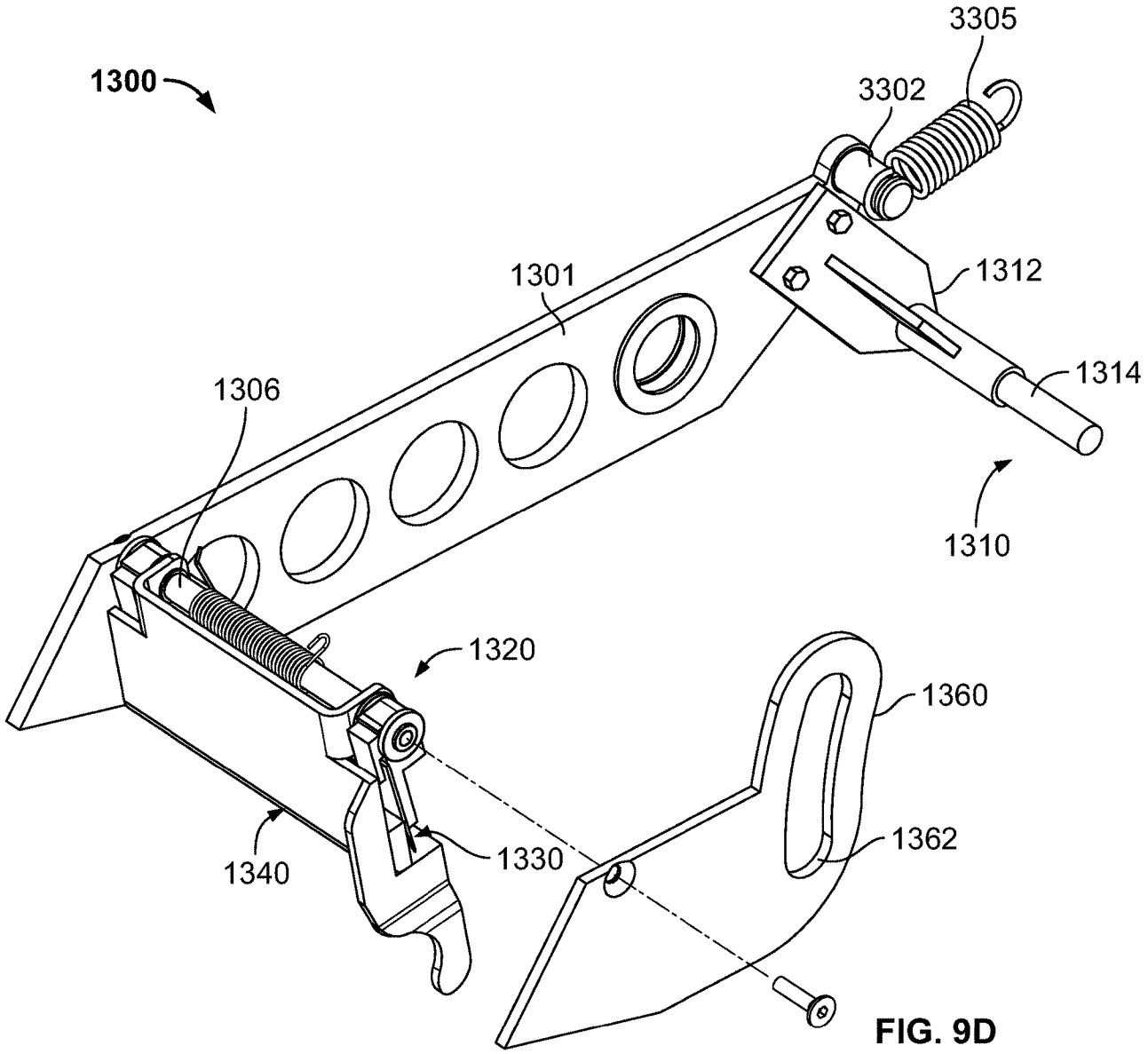

A slide block 3030 is pivotably connected on one side to the first linking member 1020 and on the other side to a rigid second linking member 3040, which is attached to the front roller arm assembly 1100. A guide member 3050 is slidably received in an opening defined through the slide block 3030. One end of the guide member 3050 is attached to a connector 3060 pivotably attached to the rear roller arm 1210. A second roller-arm-assembly-biasing element 3050*a*—here, a compression spring—circumscribes the guide member 3050 and is constrained between the connector 3060 and the slide block 3030. As the front and rear roller arms 1110 and 1210 move from their extended positions to their retracted positions, the guide member 3050 slides further through the slide block 3030. As best shown in FIG. 9C, when the front and rear roller arms 1110 and 1210 are in their retracted positions, the connector 3060 and the slide block 3030 compress the second roller-arm-assembly-biasing element 3050*a* therebetween. This imparts another force (in addition to the biasing force the first roller-arm-assembly-biasing element 3014*a* imparts) that biases the front and rear roller arms 1110 and 1120 (in part via the first linking member 1020) to return to their extended positions. This is merely one manner of biasing the front and rear roller arms to their extended positions, and any other suitable arrangement of components and/or combination of components may be employed to do so.

The cutter assembly 1300 includes a cutter-arm-biasing element 3305. A mounting post 3302 extends from the end of the cutter arm 1301 opposite the cutting device 1330. The mounting post 3302 defines a circumferential groove (not labeled) sized to receive and retain a hook at one end of the cutter-arm-biasing element 3305, which is an extension spring in this example embodiment. The hook at the other end of the cutter-arm-biasing element 3305 is attached to a shaft 1610 that extends from the mounting plate M1. The cutter-arm-biasing element 3305 biases the cutter arm 1301 to the extended position best shown in FIGS. 9A and 9B. This is merely one manner of biasing the cutter arm to its extended position, and any other suitable arrangement of components and/or combination of components may be employed to do so.

In some embodiments, the case sealer 10 with the tape cartridge 3000 operates as described above with respect to the flowchart in FIGS. 7A and 7B. In these embodiments, the roller-arm and cutter-arm actuators are configured to move the roller arms and the cutter arm to (and while maintaining them in) their respective retracted positions eliminate (or in certain embodiments reduce) the forces the roller and cutter arms apply to the box due to the biasing elements. Further, the actuators are configured to augment the biasing force of those biasing elements when moving the roller arms and the cutter arm to their respective extended positions. The biasing elements function as backups to the actuators so the tape cartridges are still usable if one or both of the actuators malfunctions.

Figure 10A:
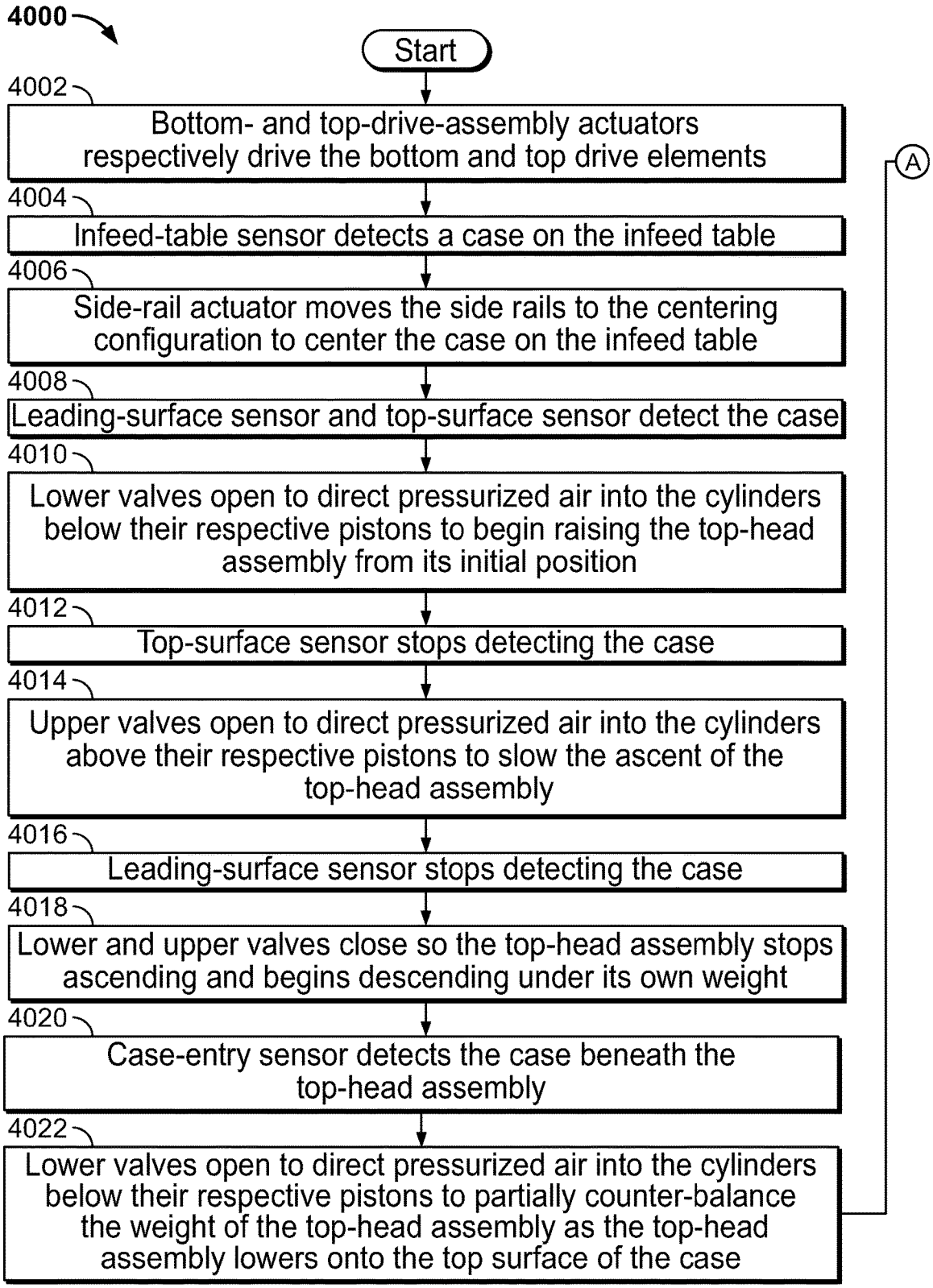
FIGS. 10A and 10B are a flowchart showing another example method of operating the case sealer of FIG. 1 including the tape cartridge of FIGS. 9A-9D to seal a case.
Figure 10B:
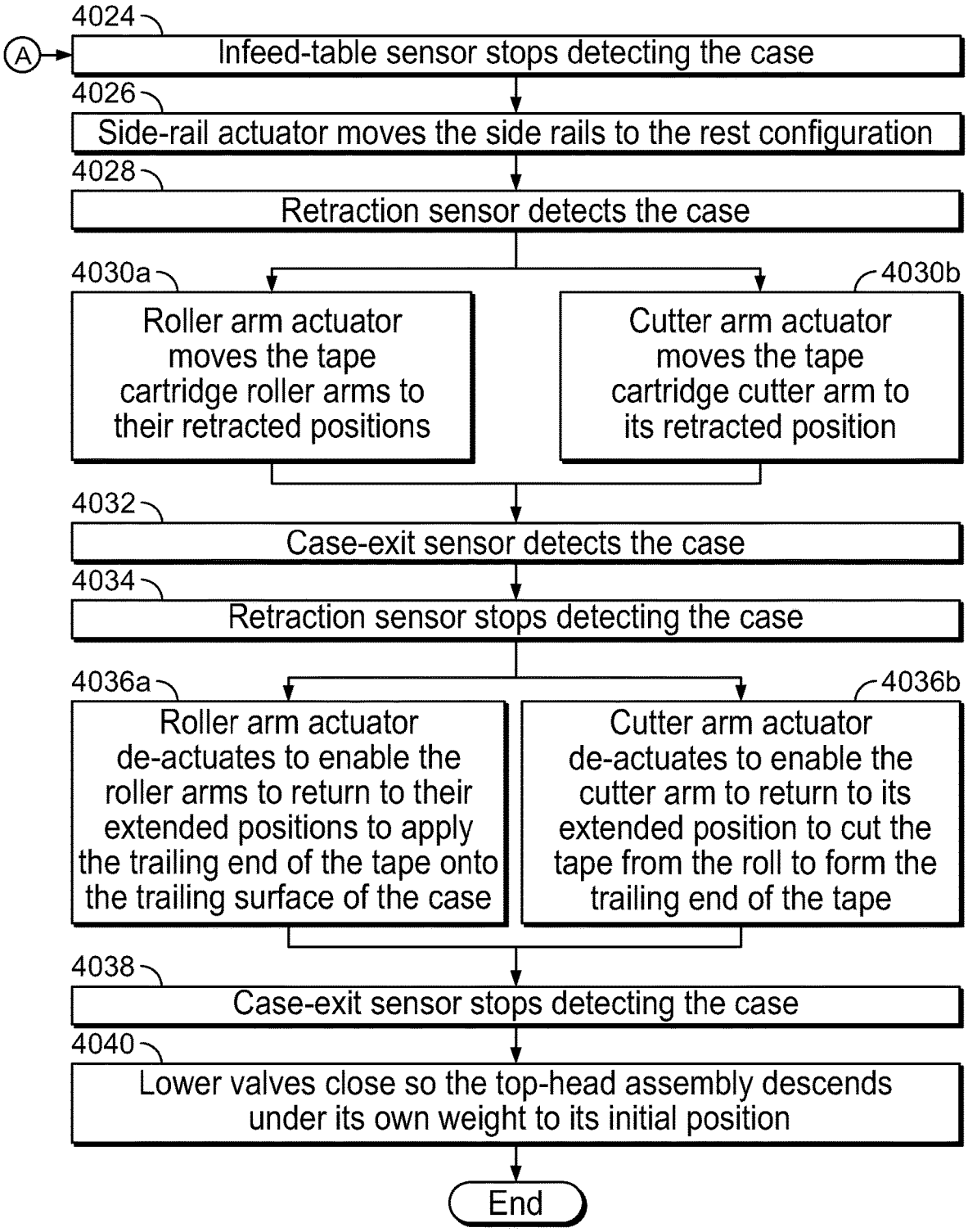

In other embodiments, the case sealer 10 with the tape cartridge 3000 operates in accordance with the method 4000 identified by the flowchart shown in FIGS. 10A and 10B. In these embodiments, the roller-arm and cutter-arm actuators are configured to actively move the roller and cutter arms to their respective retracted positions but not actively move them to their respective extended positions. Rather, after retraction, the biasing elements function to move the roller and cutter arms back to their extended positions. Accordingly, in these embodiments, the case sealer 10 either does not include the second tape-cartridge valve 1000*v*2 or controls the second tape-cartridge valve 1000*v*2 to remain closed during operation of the case sealer 10.

Turning now to FIGS. 10A and 10B, initially, the top-head assembly 300 is at its initial (lower) position, and the side rails 114*a* and 114*b* are in their rest configuration. The controller 90 controls the bottom-drive-assembly actuator 118 and the top-drive-assembly actuator 322 to drive the bottom drive element of the base assembly 100 and the top-drive element of the top-head assembly, respectively, as block 4002 indicates.

The operator positions the case C onto the infeed table 112, and the infeed-table sensor S1 detects the presence of the case C, as block 4004 indicates, and in response sends a corresponding signal to the controller 90. Responsive to receiving that signal, the controller 90 controls the side-rail valve 117*a* to direct pressurized gas into the side-rail pneumatic cylinder 117*b* on the appropriate side of the piston to cause the side-rail pneumatic cylinder 117*b* to move the side rails 114*a* and 114*b* from the rest configuration to the centering configuration so the side rails 114*a* and 114*b* move laterally inward to engage and center the case C on the infeed table 112, as block 4006 indicates.

The operator then moves the case C into contact with the leading-surface sensor S2. This causes the leading-surface sensor S2 (via the case C contacting and actuating the paddle switch of the leading-surface sensor S2) and the top-surface sensor S3 (via the case moving within a designated distance of the top-surface proximity sensor S3) to detect the case C, as block 4008 indicates, and in response send corresponding signals to the controller 90. Responsive to receiving those signals, the controller 90 controls the first and second top-head-actuating assemblies 230 and 270 to begin moving the top-head assembly 300 upward at a first speed, which is a maximum speed in this example embodiment. Specifically, the controller 90 is configured to control the first and second top-head-actuating-assembly lower valves 2301*v* and 2701*v* to direct pressurized gas into the lower ports of the cylinders 248*a* and 288*a* to pressurize the volumes below their respective pistons 248*c* and 288*c* to a first pressure to cause their respective pistons 248*c* and 288*c* to move upward and extend their respective piston rods 248*b* and 288*b* to move the top-head assembly 300 upward at the first speed, as block 4010 indicates.

The top-head assembly 300 continues moving upward at the first speed, and the top-surface sensor S3 eventually stops detecting the case C, as block 4012 indicates. This indicates that the top-surface sensor S3 has ascended above the top surface of the case C. At this point, the leading-surface sensor S2 continues to detect the case (i.e., the leading surface of the case C continues to actuate the paddle switch). In response to no longer detecting the case C, the top-surface sensor S3 sends a corresponding signal to the controller 90. Responsive to receiving that signal, the controller 90 controls the first and second top-head-actuating assemblies 230 and 270 to begin slowing the upward movement of the top-head assembly 300. Specifically, the controller 90 controls the first and second top-head-actuating-assembly upper valves 230*uv* and 270*uv* to direct pressurized gas into the upper ports of the cylinders 248*a* and 288*a*, as block 4014 indicates, to pressurize the volumes above their respective pistons 248*c* and 288*c* to a second pressure that is less than the first pressure. The pressurized gas above the respective pistons 248*c* and 288*c* partially counteracts the upward force supplied by the pressurized gas below the pistons and therefore slows the upward movement of the top-head assembly 300 to a second speed that is lower than the first speed. That is, since the first pressure of the pressurized gas below the pistons is high enough to overcome both the weight of the top-head assembly 300 and the pressurized gas above the pistons, the top-head assembly 300 continues ascending (albeit at a slower speed).

The top-head assembly 300 continues moving upward at this slower second speed, and the leading-surface sensor S2 eventually stops detecting the case C, as block 4016 indicates. This indicates that the top-head assembly 300 has ascended above the top surface of the case C. In response to no longer detecting the case C, the leading-surface sensor S2 sends a corresponding signal to the controller 90. Responsive to receiving that signal, the controller 90 controls the first and second top-head-actuating assemblies 230 and 270 to enable the top-head assembly 300 to stop its ascent and begin descending under its own weight. Specifically, the controller 90 controls the first and second lower valves 2301*v* and 2701*v* and the first and second top-head-actuating-assembly upper valves 230*uv* and 270*uv* to close, as block 4018 indicates. This de-pressurizes the first and second top-head-assembly pneumatic cylinders 248 and 288 so the weight of the top-head assembly 300 causes the top-head assembly 300 to stop moving upward and to begin descending. Any gas remaining in the first and second top-head-assembly pneumatic cylinders below their respective pistons vents to atmosphere as the top-head assembly 300 descends.

Once the top-head assembly 300 ascends above the top surface of the case C, the operator moves the case C beneath the top-head assembly 300 and into contact with the bottom-drive assembly 115. The case-entry sensor S4 detects the presence of the case C beneath the top-head assembly 300 and in response sends a corresponding signal to the controller 90, as block 4020 indicates. Responsive to receiving that signal, the controller 90 controls the first and second top-head-actuating assemblies 230 and 270 to begin to slow the descent of the top-head assembly 300 (which at this point is descending under its own weight). Specifically, the controller 90 controls the first and second top-head-actuating-assembly lower valves 2301*v* and 2701*v* to direct pressurized gas into the lower ports of the cylinders 248*a* and 288*a* to pressurize the volumes below their respective pistons 248*c* and 288*c* to a third pressure (that is less than the first pressure) to partially counter-balance the weight of the top-head assembly 300 and slow its descent onto the top surface of the case so as to not damage the case, as block 4022 indicates. That is, since the third pressure of the pressurized gas below the pistons is too low to completely counteract the weight of the top-head assembly 300, the top-head assembly 300 continues descending (albeit at a slower speed).

More generally, the controller 90 is configured to control the top-head-actuating-assembly actuators 248 and 288 to: (1) raise the top-head assembly 300 at a first speed responsive to the leading-surface sensor S2 and the top-surface sensor S3 detecting the case; (2) continue raising the top-head assembly 300 at a second slower speed responsive to the top-surface sensor S3 no longer detecting the case and the leading-surface sensor S2 still detecting the case; (3) enable gravity to stop and begin lowering the top-head assembly 300 responsive to the leading-surface sensor S2 no longer detecting the case; and (4) partially counter-balance the weight of the top-head assembly 300 responsive to the case-entry sensor S4 detecting the case.

The top- and bottom-drive assemblies 320 and 115 begin moving the case C in the direction D. The case C eventually moves off of the infeed table 112, at which point the infeed-table sensor S1 stops detecting the case C and sends a corresponding signal to the controller 90, as block 4024 indicates. Responsive to receiving that signal, the controller 90 controls the side-rail valve 117*a* to direct pressurized gas into the side-rail pneumatic cylinder 117*b* on the opposite side of the piston to cause the side-rail pneumatic cylinder 117*b* to move the side rails 114*a* and 114*b* from the centering configuration to the rest configuration to make space on the infeed table 112 for the next case to-be-sealed, as block 4026 indicates.

The top- and bottom-drive assemblies 320 and 115 continue moving the case C, and just before the leading surface of the case C contacts the front roller 1120 of the tape cartridge 1000 the retraction sensor S5 detects the presence of the case C and in response sends a corresponding signal to the controller 90, as block 4028 indicates. Responsive to receiving that signal, the controller 90 controls the roller-arm actuator 1710 and the cutter-arm actuator 1810 to move the first and second roller arms 1110 and 1120 and the cutter arm 1301 to their respective retracted positions, as blocks 4030*a* and 4030*b* indicate. Specifically, the controller 90 opens the first tape-cartridge valve 1000*v*1, which directs pressurized gas: (1) into the cylinder 1711 via the first connector and causes the piston rod 1713 to retract, which causes the front roller arm 1110 and the rear roller arm 1210 (via the first linking member 1020) to move to their respective retracted positions shown in FIG. 9C; and (2) into the cylinder 1811 via the first connector 1814 and causes the piston rod 1813 to extend, which causes the cutter arm 1301 to move to its retracted position shown in FIG. 9C.

The leading surface of the case C contacts the front roller 1120 of the tape cartridge 1000 as the front roller arm 1110 is moving to its retracted position, which causes the tape positioned on the front roller 1120 to adhere to the leading surface of the case C. The fact that the front roller arm 1110 is moving toward its retracted position when the case C contacts the front roller 1120 reduces the force the front roller arm assembly 1100 imparts to the leading surface of the case C (compared to certain prior art case sealers), which reduces the likelihood that the roller arm assemblies will damage the case C during taping (compared to certain prior art tape cartridges that do not include actuators to retract the roller arms).

When the front and rear roller arms 1110 and 1210 are in their retracted positions, the front and rear rollers 1120 and 1220 are positioned so they apply enough pressure to the tape to adhere the tape to the top surface of the case C. When the cutter arm 1301 is in its retracted position, the cutter arm 1301 does not contact the top surface of the case C (though in certain embodiments it may do so).

The controller 90 controls the first tape-cartridge valve 1000*v*1 to remain open to retain the front and rear roller arms 1110 and 1210 and the cutter arm 1301 in their respective retracted positions as the top- and bottom-drive assemblies 320 and 115 move the case C past the tape cartridge 1000. At some point, the case-exit sensor S6 detects the presence of the case C, as block 4032 indicates (though this may occur after the retraction sensor S5 stops detecting the case C depending on the length of the case).

Once the retraction sensor S5 stops detecting the case (indicating that the case has moved past the retraction sensor S5), the retraction sensor S5 sends a corresponding signal to the controller 90, as block 4034 indicates. In response, the controller 90 controls the roller-arm actuator 1710 to enable the first and second roller arms 1110 and 1120 to return to their respective extended positions to apply tape to the trailing surface of the case and controls the cutter-arm actuator 1810 to enable the cutter arm 1301 to return to its extended position to cut the tape from the roll, as blocks 4036*a* and 4036*b* indicate. Specifically, the controller 90 closes the first tape-cartridge valve 1000*v*1 to de-pressurize the corresponding sides of the cylinders 1711 and 1811. De-pressurization of the cylinders 1711 and 1811 enables the first and second roller-arm-assembly-biasing elements 3014*a* and 3050*a* to move the front roller arm 1110 and the rear roller arm 1210 (via the first linking member 1020) to their respective extended positions and enables the cutter-arm-biasing element 3305 to move the cutter arm 1301 to its extended position. As this occurs, the finger 1344 of the cutting-device cover 1340 contacts the top surface of the case so the cutting-device cover 1340 pivots to the open position and exposes the cutting device 1330. Continued movement of the cutter arm 1301 brings the toothed blade of the cutting device 1330 into contact with the tape and severs the tape from the roll R. As the front and rear roller arms 1110 and 1210 move back to their extended positions, the rear roller arm 1210 moves so the rear roller 1220 contacts the severed end of the tape and applies the tape to the trailing surface of the case C to complete the taping process.

The top- and bottom-drive assemblies 320 and 115 continue to move the case C until it exits from beneath the top-head assembly 300 onto the outfeed table 113, at which point the case-exit sensor S6 stops detecting the case, as block 4038 indicates, and sends a corresponding signal to the controller 90. Responsive to receiving that signal, the controller 90 controls the first and second top-head-actuating assemblies 230 and 270 to enable the top-head assembly 300 to descend under its own weight. Specifically, the controller 90 controls the first and second top-head-actuating-assembly lower valves 2301*v* and 2701*v* to close, as block 4040 indicates. The weight of the top-head assembly 300 causes it to descend back to its initial position. Any gas remaining in the cylinders below their respective pistons vents to atmosphere as the top-head assembly 300 descends.

In various embodiments, a case sealer of the present disclosure comprises a base assembly; a top-head assembly supported by the base assembly; a top-head-assembly actuator supported by the base assembly and operably connected to the top-head assembly to move the top-head assembly relative to the base assembly; and a controller operably connected to the top-head assembly actuator and configured to: responsive to a first sensor detecting a case to-be-sealed, control the top-head-assembly actuator to begin raising the top-head assembly; afterwards, control the top-head-assembly actuator to slow the ascent of the top-head assembly; and responsive to the first sensor no longer detecting the case, control the top-head-assembly actuator to enable the top-head assembly to stop ascending.

In certain such embodiments, the case sealer further comprises a second sensor, and the controller is further configured to control the top-head-assembly actuator to slow the ascent of the top-head assembly responsive to the second sensor no longer detecting the case.

In certain such embodiments, the controller is further configured to control the top-head-assembly actuator to begin raising the top-head assembly responsive to the first and second sensors both detecting the case.

In certain such embodiments, the top-head-assembly actuator comprises a double-acting pneumatic cylinder comprising a cylinder, a piston slidably disposed within an interior of the cylinder, and a piston rod having one end attached to the piston and another end external to the cylinder and operably connected to the top-head assembly.

In certain such embodiments, the case sealer further comprises a top-head-actuating assembly including the pneumatic cylinder, a first valve fluidly connectable to a pressurized gas source and the interior of the cylinder of the pneumatic cylinder on a first side of the piston, and a second valve fluidly connectable to the pressurized gas source and the interior of the cylinder of the pneumatic cylinder on an opposing second side of the piston.

In certain such embodiments, the controller is operably connected to the second valve and configured to, responsive to the first sensor detecting the case, control the second valve to pressurize the interior of the cylinder on the second side of the piston to a first pressure to begin raising the top-head assembly.

In certain such embodiments, the controller is operably connected to the first valve and further configured to control the first valve to pressurize the interior of the cylinder on the first side of the piston to a second pressure lower than the first pressure to slow the ascent of the top-head assembly.

In certain such embodiments, the controller is further configured to, responsive to the first sensor no longer detecting the case, control the first and second valves to enable the top-head assembly to stop ascending and begin lowering under its own weight.

In certain such embodiments, the controller is further configured to, responsive to the first sensor no longer detecting the case, control the first and second valves to stop directing gas into the interior of the cylinder to enable the top-head assembly to stop ascending and begin lowering under its own weight.

In certain such embodiments, the case sealer further comprises a third sensor communicatively connected to the controller, the controller further configured to, responsive to the third sensor detecting the case, control the second valve to pressurize the interior of the cylinder on the second side of the piston to a third pressure lower than the first pressure to partially counter-balance the top-head assembly.

In certain such embodiments, the case sealer further comprises a fourth sensor communicatively connected to the controller, the controller further configured to, responsive to the fourth sensor no longer detecting the case, control the second valve to enable the top-head assembly to lower under its own weight.

In certain such embodiments, the controller is further configured to, responsive to the fourth sensor no longer detecting the case, control the second valve to stop directing gas into the interior of the cylinder to enable the top-head assembly to lower under its own weight.

In certain such embodiments, the case sealer further comprises a third sensor communicatively connected to the controller, the controller further configured to, responsive to the third sensor detecting the case, control the top-head-assembly actuator to lower the top-head assembly onto the case.

In certain such embodiments, the controller is further configured to, responsive to the first sensor no longer detecting the case, control the top-head-assembly actuator to stop the top-head assembly from ascending.

In certain such embodiments, the controller is configured to control the top-head-assembly actuator to slow the ascent of the top-head assembly while the first sensor still detects the case.

In certain such embodiments, the case sealer further comprises a tape cartridge comprising a roller arm comprising a roller, a cutter arm comprising a cutting device, a roller arm actuator operably coupled to the roller arm to move the roller arm between a roller arm retracted position and a roller arm extended position, and a cutter arm actuator operably coupled to the cutter arm to move the cutter arm between a cutter arm retracted position and a cutter arm extended position.

In certain such embodiments, the case sealer further comprises a retraction sensor, and the controller is operably connected to the roller and cutter arm actuators and further configured to, responsive to receiving a first signal from the retraction sensor, control the roller and cutter arm actuators to respectively move the roller and cutter arms from their extended positions to their retracted positions.

In certain such embodiments, the controller is further configured to, responsive to receiving a second signal from the retraction sensor after the first signal, control the roller and cutter arm actuators to respectively move the roller and cutter arms from their retracted positions to their extended positions.

In certain such embodiments, the case is not in contact with the tape cartridge when the controller receives the first signal.

In certain such embodiments, the case contacts the tape cartridge when the controller receives the second signal.

In various embodiments, a method of operating a case sealer of the present disclosure comprises: responsive to a first sensor detecting a case to-be-sealed, begin raising a top-head assembly relative to a base assembly; afterwards, slowing the ascent of the top-head assembly; and responsive to the first sensor no longer detecting the case, enabling the top-head assembly to stop ascending.

In certain such embodiments, the method further comprises slowing the ascent of the top-head assembly while the first sensor still detects the case.

In certain such embodiments, the method further comprises slowing the ascent of the top-head assembly responsive to a second sensor no longer detecting the case.

In certain such embodiments, the method further comprises begin raising the top-head assembly relative to the base assembly responsive to the first and second sensors both detecting the case.

In certain such embodiments, the method further comprises, responsive to the first sensor detecting the case, controlling a second valve to pressurize an interior of a cylinder on a second side of a piston slidably disposed in the cylinder to a first pressure to begin raising the top-head assembly.

In certain such embodiments, the method further comprises controlling a first valve to pressurize the interior of the cylinder on a first side of the piston to a second pressure lower than the first pressure to slow the ascent of the top-head assembly.

In certain such embodiments, the method further comprises, responsive to the first sensor no longer detecting the case, controlling the first and second valves to enable the top-head assembly to stop ascending and begin lowering under its own weight.

In certain such embodiments, the method further comprises, responsive to the first sensor no longer detecting the case, controlling the first and second valves to stop directing gas into the interior of the cylinder to enable the top-head assembly to stop ascending and begin lowering under its own weight.

In certain such embodiments, the method further comprises, responsive to a third sensor detecting the case, controlling the second valve to pressurize the interior of the cylinder on the second side of the piston to a third pressure lower than the first pressure to partially counter-balance the top-head assembly.

In certain such embodiments, the method further comprises, responsive to a fourth sensor no longer detecting the case, enabling the top-head assembly to lower under its own weight.

In certain such embodiments, the method further comprises, responsive to the fourth sensor no longer detecting the case, controlling the second valve to stop directing gas into the interior of the cylinder to enable the top-head assembly to lower under its own weight.

In certain such embodiments, the method further comprises, responsive to a third sensor detecting the case, lowering the top-head assembly onto the case.

In certain such embodiments, the method further comprises, responsive to the first sensor no longer detecting the case, stopping the top-head-assembly actuator from ascending.

In various embodiments, a case sealer of the present disclosure comprises a tape cartridge configured to apply tape from a tape supply to a case and comprising a cutter arm and a cutter arm actuator operably coupled to the cutter arm to move the cutter arm between a retracted position and an extended position; a case sensor; and a controller communicatively coupled to the case sensor and operably coupled to the cutter arm actuator to, responsive to receipt of a signal from the case sensor, control the cutter arm actuator to move the cutter arm from the retracted position to the extended position to cut the tape from the tape supply.

In certain such embodiments, the signal indicates that the case sensor no longer detects the presence of the case.

In certain such embodiments, the signal is a second signal, and the controller is operably coupled to the cutter arm actuator to, responsive to receipt of a first signal from the case sensor, control the cutter arm actuator to move the cutter arm from the extended position to the retracted position.

In certain such embodiments, the first signal indicates that the case sensor detects the presence of the case.

In certain such embodiments, the second signal indicates that the case sensor no longer detects the presence of the case.

In certain such embodiments, the cutter arm actuator comprises a double-acting pneumatic cylinder.

In certain such embodiments, the cutter arm actuator comprises a pneumatic cylinder, and the controller is configured to control the cutter arm actuator to move the cutter arm from the retracted position to the extended position by controlling a flow of pressurized gas into the pneumatic cylinder.

In certain such embodiments, the tape cartridge further comprises a front roller arm, a front roller attached to the front roller arm, and a roller arm actuator operably coupled to the front roller arm to move the front roller arm between a retracted position and an extended position, and the controller is operably coupled to the roller arm actuator to, responsive to receipt of the signal from the case sensor, control the roller arm actuator to move the front roller arm from the retracted position to the extended position.

In certain such embodiments, the signal is a second signal, and the controller is operably coupled to the roller arm actuator to control the roller arm actuator to, responsive to receipt of a first signal from the case sensor, move the roller arm from the extended position to the retracted position.

In certain such embodiments, the first signal indicates that the case sensor detects the presence of the case.

In certain such embodiments, the second signal indicates that the case sensor no longer detects the presence of the case.

In certain such embodiments, the roller arm actuator comprises a double-acting pneumatic cylinder, and the controller is operably coupled to the cutter arm actuator to, responsive to receipt of a first signal from the case sensor, control the cutter arm actuator to move the cutter arm from the extended position to the retracted position.

In certain such embodiments, the front roller is below the cutter arm when the front roller arm and the cutter arm are in their respective retracted positions.

In various embodiments, a method of operating a case sealer of the present disclosure comprises controlling a drive assembly to move a case relative to a tape cartridge such that the case contacts the tape cartridge and the tape cartridge applies tape from a tape supply to the case; and after the tape cartridge begins applying the tape to the case, responsive to receipt of a signal from a case sensor, controlling a cutter arm actuator to move a cutter arm of the tape cartridge from a retracted position to an extended position to cut the tape from the tape supply.

In certain such embodiments, the signal is a second signal, and the method further comprises controlling the cutter arm actuator to move the cutter arm from the extended position to the retracted position responsive to receipt of a first signal from the case sensor.

In certain such embodiments, the first signal indicates that the case sensor detects the presence of the case.

In certain such embodiments, the second signal indicates that the case sensor no longer detects the presence of the case.

In certain such embodiments, controlling the cutter arm actuator to move the cutter arm of the tape cartridge from the retracted position to the extended position comprises controlling a flow of pressurized gas into the cutter arm actuator.

In certain such embodiments, the method further comprises controlling a roller arm actuator to move front and rear roller arms of the tape cartridge from respective retracted positions to respective extended positions responsive to receipt of the signal from the case sensor.

In certain such embodiments, the signal is a second signal, and the method further comprises controlling the roller arm actuator to, responsive to receipt of a first signal from the case sensor, move the front and rear roller arms from the respective extended positions to the respective retracted positions and controlling the cutter arm actuator to move the cutter arm from the extended position to the retracted position, wherein respective front and rear rollers of the front and rear roller arms are positioned when in their respective retracted positions to apply the tape onto a top surface of the case, wherein the front and rear rollers are below the cutter arm when the front and rear roller arms and the cutter arm are in their respective retracted positions.

In various embodiments, a tape cartridge of the present disclosure comprises one or more mounting plates; a front roller arm comprising a front roller and mounted to the one or more mounting plates; a roller arm actuator operably coupled to the front roller arm to move the front roller arm relative to the one or more mounting plates between a front roller arm retracted position and a front roller arm extended position; a cutter arm comprising a cutting device and mounted to the one or more mounting plates; and a cutter arm actuator operably coupled to the cutter arm to move the cutter arm relative to the one or more mounting plates between a cutter arm retracted position and a cutter arm extended position. The roller arm actuator and the cutter arm actuator are configured to: responsive to the case reaching a first position relative to the tape cartridge, respectively move the front roller arm and the cutter arm from their extended positions to their retracted positions; and responsive to the case reaching a second position relative to the tape cartridge, respectively move the front roller arm and the cutter arm from their retracted positions to their extended positions.

In certain such embodiments, the case is not in contact with the tape cartridge when in the first position.

In certain such embodiments, the case is in contact with the tape cartridge when in the second position.

In certain such embodiments, the roller arm actuator and the cutter arm actuator each comprise a double-acting pneumatic cylinder.

In certain such embodiments, the tape cartridge further comprises a rear roller arm comprising a rear roller and mounted to the one or more mounting plates, and the front roller arm and the rear roller arm are connected such that movement of the front roller arm from the front roller arm extended position to the front roller arm retracted position causes the rear roller to move relative to the one or more mounting plates from a rear roller arm extended position to a rear roller arm retracted position.

In certain such embodiments, the front and rear rollers are below the cutter arm when the front roller arm, the rear roller arm, and the cutter arm are in their respective retracted positions.

In certain such embodiments, the case is not in contact with the tape cartridge when in the first position, wherein the case is in contact with the tape cartridge when in the second position.

The invention claimed is:

1. A case sealer comprising:

a base assembly;

a top-head assembly supported by the base assembly;

a top-head-assembly actuator supported by the base assembly and operably connected to the top-head assembly to move the top-head assembly relative to the base assembly;

a first sensor and a second sensor; and a controller operably connected to the top-head assembly actuator and configured to:

responsive to the first sensor and the second sensor detecting a case to-be-sealed, control the top-head-assembly actuator to begin raising the top-head assembly;

afterwards, responsive to the second sensor no longer detecting the case to-be-sealed, and while the first sensor still detects the case to-be-sealed, control the top-head-assembly actuator to slow the ascent of the top-head assembly without stopping the ascent of the top-head assembly; and afterwards and responsive to the first sensor no longer detecting the case to-be-sealed, control the top-head-assembly actuator to enable the top-head assembly to stop ascending.

2. The case sealer of claim 1, wherein the top-head-assembly actuator comprises a double-acting pneumatic cylinder comprising a cylinder, a piston slidably disposed within an interior of the cylinder, and a piston rod having one end attached to the piston and another end external to the cylinder and operably connected to the top-head assembly.

3. The case sealer of claim 2, further comprising a top-head-actuating assembly including the pneumatic cylinder, a first valve fluidly connectable to a pressurized gas source and the interior of the cylinder of the pneumatic cylinder on a first side of the piston, and a second valve fluidly connectable to the pressurized gas source and the interior of the cylinder of the pneumatic cylinder on an opposing second side of the piston.

4. The case sealer of claim 3, wherein the controller is operably connected to the second valve and configured to, responsive to the first sensor detecting the case to-be-sealed, control the second valve to pressurize the interior of the cylinder on the second side of the piston to a first pressure to begin raising the top-head assembly.

5. The case sealer of claim 4, wherein the controller is operably connected to the first valve and further configured to control the first valve to pressurize the interior of the cylinder on the first side of the piston to a second pressure lower than the first pressure to slow the ascent of the top-head assembly.

6. The case sealer of claim 5, wherein the controller is further configured to, responsive to the first sensor no longer detecting the case to-be-sealed, control the first and second valves to enable the top-head assembly to stop ascending and begin lowering under its own weight.

7. The case sealer of claim 6, wherein the controller is further configured to, responsive to the first sensor no longer detecting the case to-be-sealed, control the first and second valves to stop directing gas into the interior of the cylinder to enable the top-head assembly to stop ascending and begin lowering under its own weight.

8. The case sealer of claim 6, further comprising a third sensor communicatively connected to the controller, the controller further configured to, responsive to the third sensor detecting the case to-be-sealed, control the second valve to pressurize the interior of the cylinder on the second side of the piston to a third pressure lower than the first pressure to partially counter-balance the top-head assembly.

9. The case sealer of claim 8, further comprising a fourth sensor communicatively connected to the controller, the controller further configured to, responsive to the fourth sensor no longer detecting the case to-be-sealed, control the second valve to enable the top-head assembly to lower under its own weight.

10. The case sealer of claim 9, wherein the controller is further configured to, responsive to the fourth sensor no longer detecting the case to-be-sealed, control the second valve to stop directing gas into the interior of the cylinder to enable the top-head assembly to lower under its own weight.

11. The case sealer of claim 1, further comprising a third sensor communicatively connected to the controller, the controller further configured to, responsive to the third sensor detecting the case to-be-sealed, control the top-head-assembly actuator to lower the top-head assembly onto the case.

12. The case sealer of claim 1, wherein the controller is further configured to, responsive to the first sensor no longer detecting the case to-be-sealed, control the top-head-assembly actuator to stop the top-head assembly from ascending.

13. The case sealer of claim 1, further comprising a tape cartridge comprising a roller arm comprising a roller, a cutter arm comprising a cutting device, a roller arm actuator operably coupled to the roller arm to move the roller arm between a roller arm retracted position and a roller arm extended position, and a cutter arm actuator operably coupled to the cutter arm to move the cutter arm between a cutter arm retracted position and a cutter arm extended position.

14. The case sealer of claim 13, further comprising a retraction sensor, wherein the controller is operably connected to the roller and cutter arm actuators and further configured to, responsive to receiving a first signal from the retraction sensor, control the roller and cutter arm actuators to respectively move the roller and cutter arms from their extended positions to their retracted positions.

15. The case sealer of claim 14, wherein the controller is further configured to, responsive to receiving a second signal from the retraction sensor after the first signal, control the roller and cutter arm actuators to respectively move the roller and cutter arms from their retracted positions to their extended positions.

16. The case sealer of claim 15, wherein the case to-be-sealed is not in contact with the tape cartridge when the controller receives the first signal.

17. The case sealer of claim 16, wherein the case to-be-sealed contacts the tape cartridge when the controller receives the second signal.

* * * * *